US007900622B2

(12) United States Patent
Douglas et al.

(10) Patent No.: US 7,900,622 B2
(45) Date of Patent: Mar. 8, 2011

(54) PAINTBALL MARKER WITH USER SELECTABLE FIRING MODES

(75) Inventors: Jeffrey P. Douglas, Fort Wayne, IN (US); Dennis J. Tippmann, Jr., Fort Wayne, IN (US)

(73) Assignee: Tippmann Sports LLC, Fort Wayne, IN (US)

( * ) Notice: Subject to any disclaimer, the term of this patent is extended or adjusted under 35 U.S.C. 154(b) by 342 days.

(21) Appl. No.: 12/133,661

(22) Filed: Jun. 5, 2008

(65) Prior Publication Data

US 2009/0025701 A1 Jan. 29, 2009

Related U.S. Application Data

(63) Continuation-in-part of application No. 12/016,370, filed on Jan. 18, 2008, now Pat. No. 7,699,047.

(60) Provisional application No. 60/880,989, filed on Jan. 18, 2007, provisional application No. 60/942,144, filed on Jun. 5, 2007.

(51) Int. Cl.
*F41B 11/00* (2006.01)

(52) U.S. Cl. ..... 124/73; 124/32; 89/129.01; 89/129.02; 89/135; 42/70.06

(58) Field of Classification Search ..... 42/1.01, 42/70.06, 70.11, 71.02, 84; 89/129.01, 129.02, 89/135; 124/71–77, 31, 32
See application file for complete search history.

(56) References Cited

U.S. PATENT DOCUMENTS

| | | | | |
|---|---|---|---|---|
| 5,027,542 | A | | 7/1991 | Simonetti |
| 5,079,901 | A | | 1/1992 | Kotsiopoulos |
| 5,226,687 | A | | 7/1993 | Currie |
| 5,228,427 | A | | 7/1993 | Gardner, Jr. |
| 5,254,379 | A | | 10/1993 | Kotsiopoulos et al. |
| 5,272,828 | A | * | 12/1993 | Petrick et al. ..... 42/84 |
| 5,280,778 | A | | 1/1994 | Kotsiopoulos |
| 5,588,280 | A | | 12/1996 | Kotsiopoulos |
| 5,603,179 | A | * | 2/1997 | Adams ..... 42/70.08 |
| 5,622,159 | A | | 4/1997 | Liu et al. |
| 5,639,526 | A | | 6/1997 | Kotsiopoulos et al. |
| 5,704,342 | A | | 1/1998 | Gibson et al. |
| 5,755,213 | A | | 5/1998 | Gardner, Jr. et al. |
| 5,771,875 | A | | 6/1998 | Sullivan |
| 5,784,861 | A | | 7/1998 | Kotsiopoulos |
| 5,791,325 | A | | 8/1998 | Anderson |
| 5,881,707 | A | | 3/1999 | Gardner, Jr. |
| 5,913,303 | A | | 6/1999 | Kotsiopoulos |
| 5,941,053 | A | | 8/1999 | Kotsiopoulos |
| 5,947,100 | A | | 9/1999 | Anderson |
| 5,957,119 | A | | 9/1999 | Perry et al. |
| 5,967,133 | A | | 10/1999 | Gardner, Jr. |
| 5,993,215 | A | | 11/1999 | Kotsiopoulos et al. |
| 6,024,077 | A | | 2/2000 | Kotsiopoulos |

(Continued)

FOREIGN PATENT DOCUMENTS

EP 276843 A2 * 8/1988

*Primary Examiner* — Troy Chambers
(74) *Attorney, Agent, or Firm* — Barnes & Thornburg LLP

(57) ABSTRACT

A paintball marker with a barrel that is coupled to a receiver. The marker may include a grip assembly in which an electronic circuit is disposed. The electronic circuit is configured to actuate launching of a projectile responsive to the trigger moving to the firing position.

42 Claims, 26 Drawing Sheets

U.S. PATENT DOCUMENTS

| | | | | |
|---|---|---|---|---|
| 6,035,843 | A | 3/2000 | Smith et al. | |
| 6,062,208 | A | 5/2000 | Seefeldt et al. | |
| 6,142,137 | A | 11/2000 | MacLaughlin | |
| 6,226,915 | B1 | 5/2001 | Kotsiopoulos | |
| 6,237,647 | B1 | 5/2001 | Pong et al. | |
| 6,305,367 | B1 | 10/2001 | Kotsiopoulos et al. | |
| 6,305,941 | B1 | 10/2001 | Kotsiopoulos et al. | |
| 6,367,465 | B1 | 4/2002 | Buccieri, Jr. | |
| 6,418,919 | B1 | 7/2002 | Perrone | |
| 6,433,531 | B1 | 8/2002 | Regev | |
| 6,467,473 | B1 | 10/2002 | Kostiopoulos | |
| 6,474,326 | B1 | 11/2002 | Smith et al. | |
| 6,488,019 | B2 | 12/2002 | Kotsiopoulos | |
| 6,568,381 | B2 | 5/2003 | Chang | |
| 6,584,910 | B1 | 7/2003 | Plass | |
| 6,609,511 | B2 | 8/2003 | Kotsiopoulos et al. | |
| 6,615,814 | B1 | 9/2003 | Rice et al. | |
| 6,637,421 | B2 | 10/2003 | Smith et al. | |
| 6,644,293 | B2 | 11/2003 | Jong | |
| 6,644,295 | B2 | 11/2003 | Jones | |
| 6,644,296 | B2 | 11/2003 | Gardner, Jr. | |
| 6,684,873 | B1 | 2/2004 | Anderson et al. | |
| 6,694,963 | B1 | 2/2004 | Taylor | |
| 6,722,108 | B1 | 4/2004 | Kotsiopoulos | |
| 6,748,938 | B2 | 6/2004 | Rice et al. | |
| 6,802,305 | B1 | 10/2004 | Hatcher | |
| 6,810,871 | B2 | 11/2004 | Jones | |
| 6,857,422 | B2 | 2/2005 | Pedicini et al. | |
| 6,901,923 | B2 | 6/2005 | Jones | |
| 6,941,693 | B2 | 9/2005 | Rice et al. | |
| 6,965,542 | B1 | 11/2005 | Harrington et al. | |
| 6,973,748 | B2 | 12/2005 | Rice | |
| 6,978,657 | B1 | 12/2005 | Baumann et al. | |
| 7,017,569 | B2 | 3/2006 | Jong | |
| 7,044,119 | B2 | 5/2006 | Jones | |
| 7,073,284 | B2 | 7/2006 | Monks et al. | |
| 7,076,906 | B2 | 7/2006 | Monks et al. | |
| D526,030 | S | 8/2006 | Jones | |
| 7,082,823 | B1 | 8/2006 | Shipman et al. | |
| 7,084,780 | B2 | 8/2006 | Nguyen et al. | |
| 7,089,697 | B2 | 8/2006 | Monks | |
| 7,121,272 | B2 | 10/2006 | Jones | |
| D533,908 | S | 12/2006 | Jones | |
| 7,150,276 | B1 | 12/2006 | Rice | |
| D535,709 | S | 1/2007 | Jones | |
| 7,159,585 | B2 | 1/2007 | Quinn et al. | |
| 7,185,646 | B2 | 3/2007 | Jones | |
| 7,581,954 | B2 * | 9/2009 | Schavone | 434/18 |
| 7,765,999 | B1 * | 8/2010 | Stephens et al. | 124/73 |
| 2001/0042543 | A1 * | 11/2001 | Perrone | 124/77 |
| 2003/0106545 | A1 * | 6/2003 | Verini | 124/74 |
| 2003/0127085 | A1 * | 7/2003 | Brunette et al. | 124/74 |
| 2003/0178018 | A1 * | 9/2003 | Cherry | 124/76 |
| 2003/0221684 | A1 * | 12/2003 | Rice | 124/71 |
| 2005/0155589 | A1 * | 7/2005 | Monks | 124/31 |
| 2005/0263147 | A1 * | 12/2005 | Hatcher | 124/31 |
| 2007/0062510 | A1 * | 3/2007 | Broersma | 124/74 |
| 2010/0071679 | A1 * | 3/2010 | DeHaan et al. | 124/77 |
| 2010/0154767 | A1 * | 6/2010 | Masse | 124/77 |

* cited by examiner

PAINTBALL MARKER WITH USER SELECTABLE FIRING MODES

RELATED APPLICATIONS

This application is a continuation-in-part application of U.S. application Ser. No. 12/016,370, filed Jan. 18, 2008, which claimed priority to U.S. Provisional Application Ser. No. 60/880,989, filed on Jan. 18, 2007, the entire disclosures of which are hereby incorporated by reference. This application also claims the benefit of U.S. Provisional Application Ser. No. 60/942,144, filed on Jun. 5, 2007, the entire disclosure of which is hereby incorporated by reference.

TECHNICAL FIELD

The present invention relates generally to paintball markers, and like devices for firing frangible projectiles.

BACKGROUND

Paintball is a popular sport in which opposing sides attempt to seek out and "shoot" one another with paintballs. Players use paintball markers (also known as paintball guns) to propel the paintballs with compressed gas or combustible fuel. The paintballs are designed to break upon impact and leave a visible mark.

Since paintball games often simulate combat, paintball markers that resemble military equipment are desirable to increase the realism of the experience. For example, paintball markers have been modified to resemble assault rifles, sniper rifles, etc. In some cases, however, such modifications can be difficult to install and remove. Moreover, the modifications may detract from the marker's functionality and reliability.

SUMMARY

According to one aspect, the invention provides a paintball marker with a barrel that is coupled to a receiver. A valve arrangement is provided to selectively vent gas to propel projectiles through the barrel responsive to actuation of a firing mechanism. The marker may include a tool box that is capable of being coupled with the receiver. Typically, the tool box resembles a magazine that feeds projectiles into the receiver. For example, the tool box could resemble an M-16 or AK-47 style magazine. In some embodiments, the tool box includes a storage compartment configured to hold one or more items for maintaining the marker.

According to another aspect, the invention provides a tool box for use with a paintball marker. The tool box may have a body with a proximate end capable of being detachably coupled with a receiver of a paintball marker and a distal end. In some embodiments, the body defines a storage compartment configured to hold one or more items for maintaining the marker.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The following description references the attached drawings which were given as non-limiting examples only, in which.

Corresponding reference characters indicate corresponding parts throughout the several views. The exemplifications set out herein are illustrative, and are not to be construed as limiting the scope of the invention in any manner.

DETAILED DESCRIPTION OF THE DRAWINGS

FIGS. 1-9 illustrate an example paintball marker 100 constructed according to an embodiment of the present invention. The invention could be implemented in a manual, semi-automatic, or automatic marker, even though a semi-automatic marker is shown for purposes of illustration. It should be appreciated that the marker 100 could use a variety of propellants to propel paintballs (or other projectiles) from the marker 100. The term "propellant" is broadly intended to encompass both compressed gas, such as carbon dioxide and nitrogen, as well as combustible fuel, such as propane, butane, and methylacetylene-propadiene ("MAPP").

In the example shown, the marker 100 includes a barrel 102 through which projectiles may be propelled. As shown, the barrel 102 is coupled with a receiver 104, which defines an interior cavity dimensioned to house internal components of the marker 100. As used herein, the term "coupled" is broadly intended to encompass both direct and indirect connections. Typically, the barrel 102 includes external threads that may be received by internal threads in the receiver 104. By way of other examples, the barrel 102 may attach to the receiver 104 with an interference fit, frictional fit, or unitary formation. The receiver 104 may be formed from a variety of materials, such as aluminum, stainless steel, magnesium, or composites. In embodiments in which the receiver 104 is made of magnesium, it has been found that the production molds last substantially longer than that of aluminum. In some embodiments, the receiver 104 may have a clamshell-type body.

Figure 7:
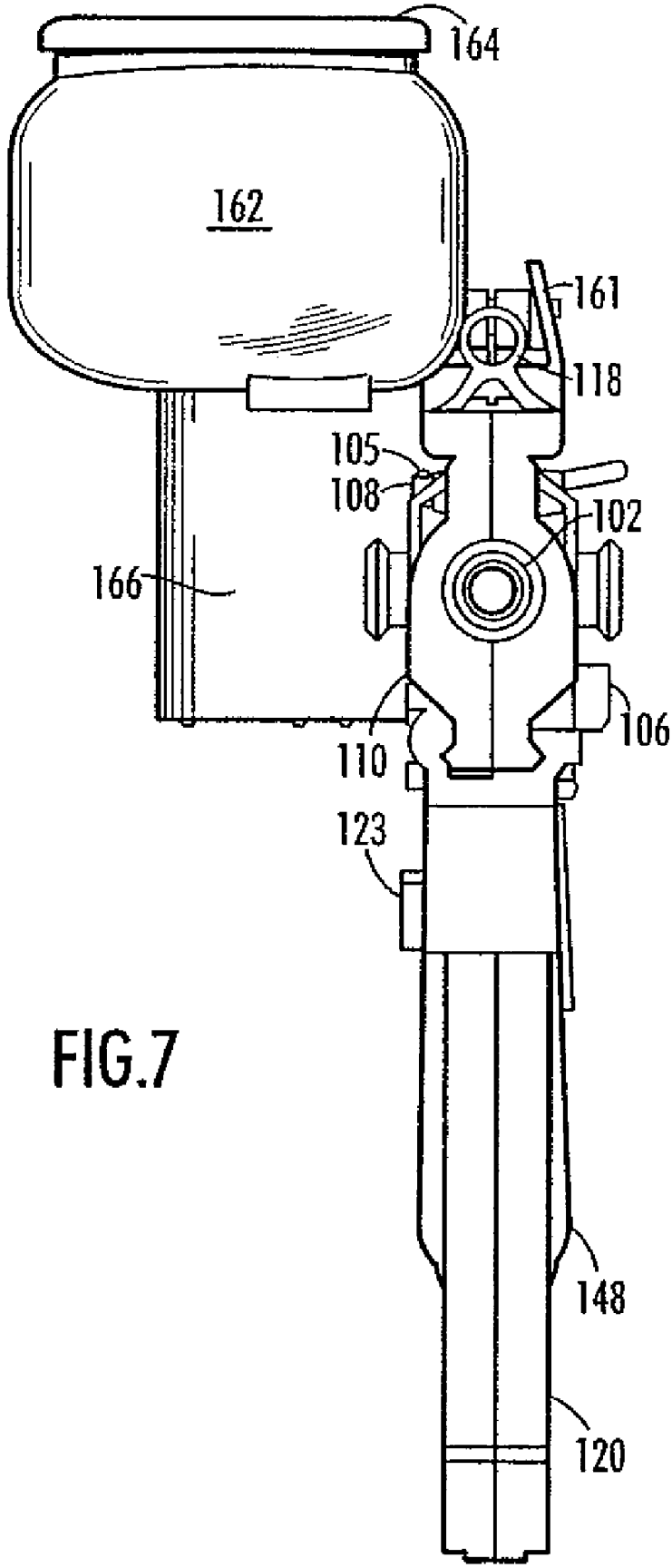
FIG. 7 is a front view of the example paintball marker shown in FIG. 1.
Figure 8:
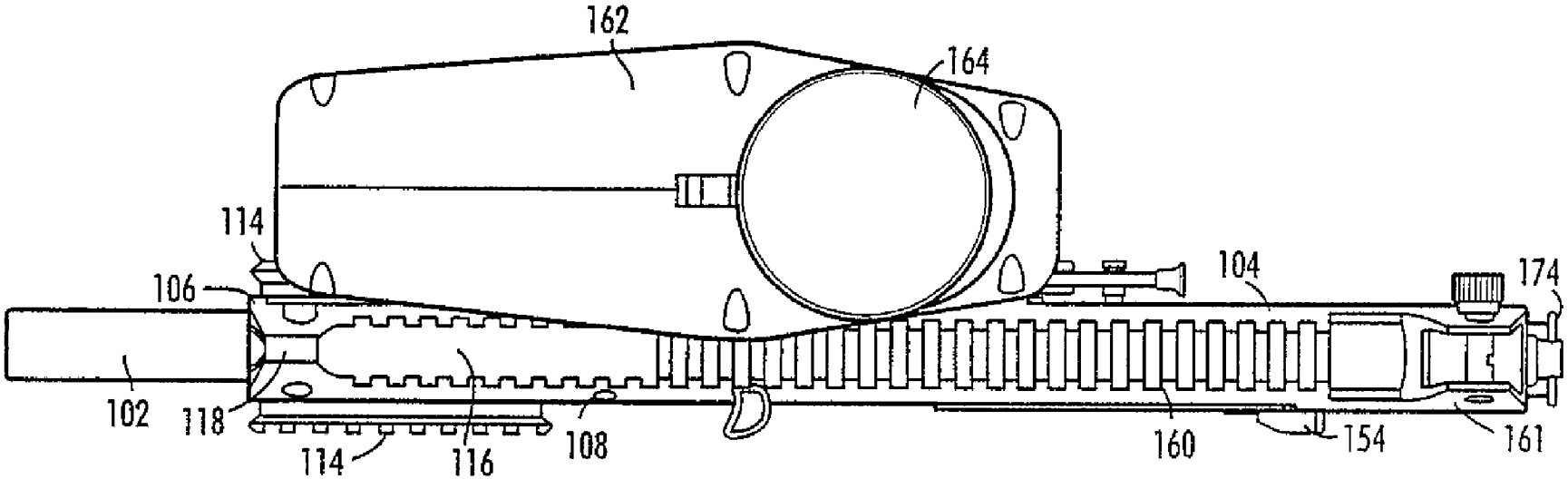
FIG. 8 is a top view of the example paintball marker shown in FIG. 1.
Figure 9:
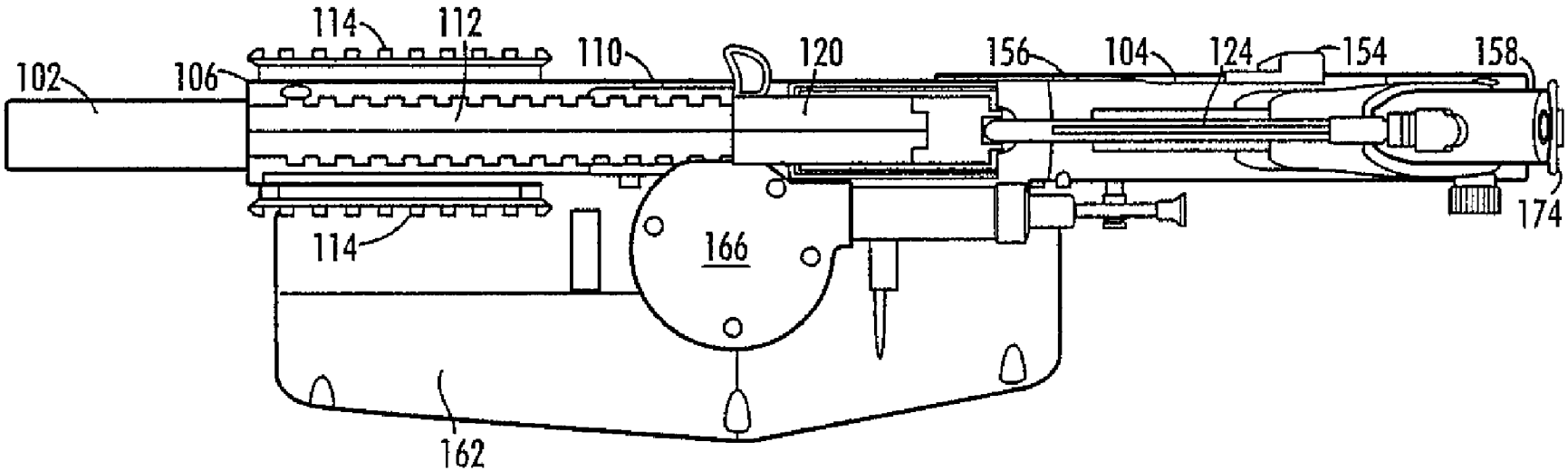
FIG. 9 is a bottom view of the example paintball marker shown in FIG. 1.
Figure 10:
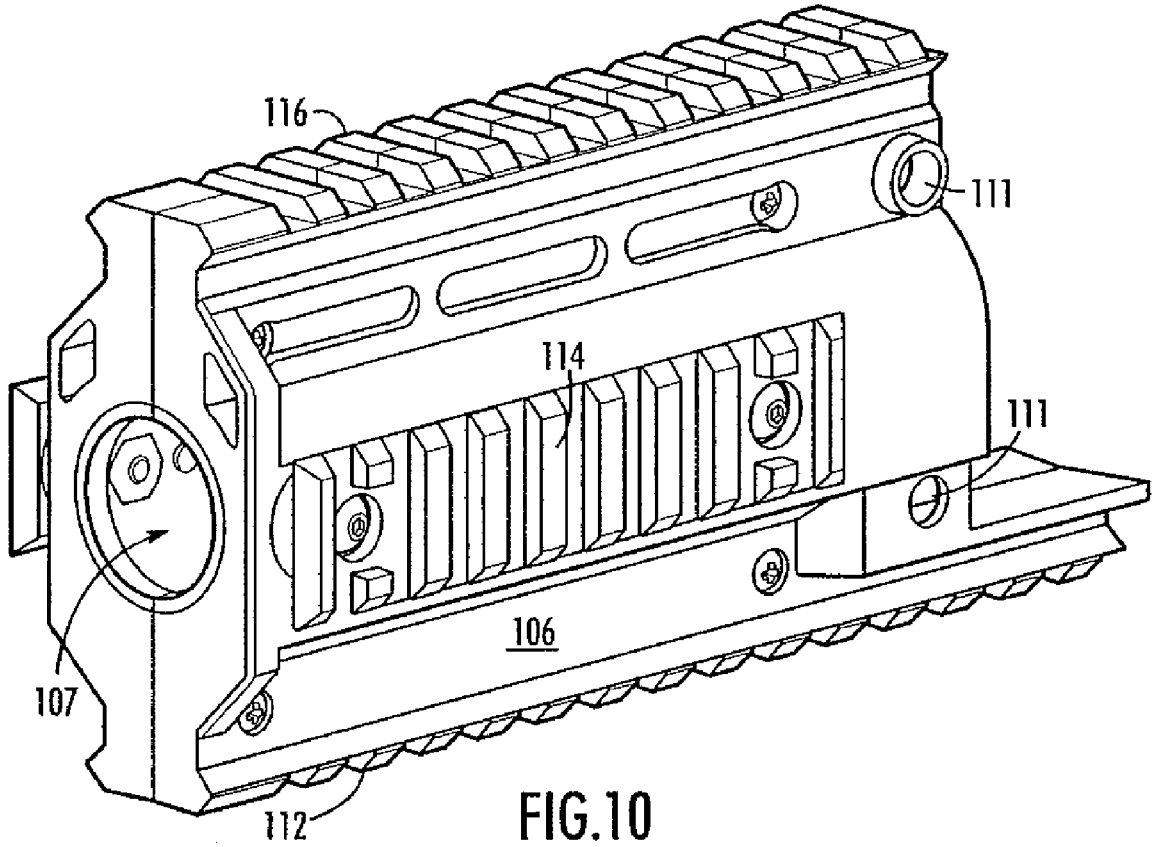
FIG. 10 is a detailed perspective view of the forestock shown in the example paintball marker of FIG. 1.
Figure 11:
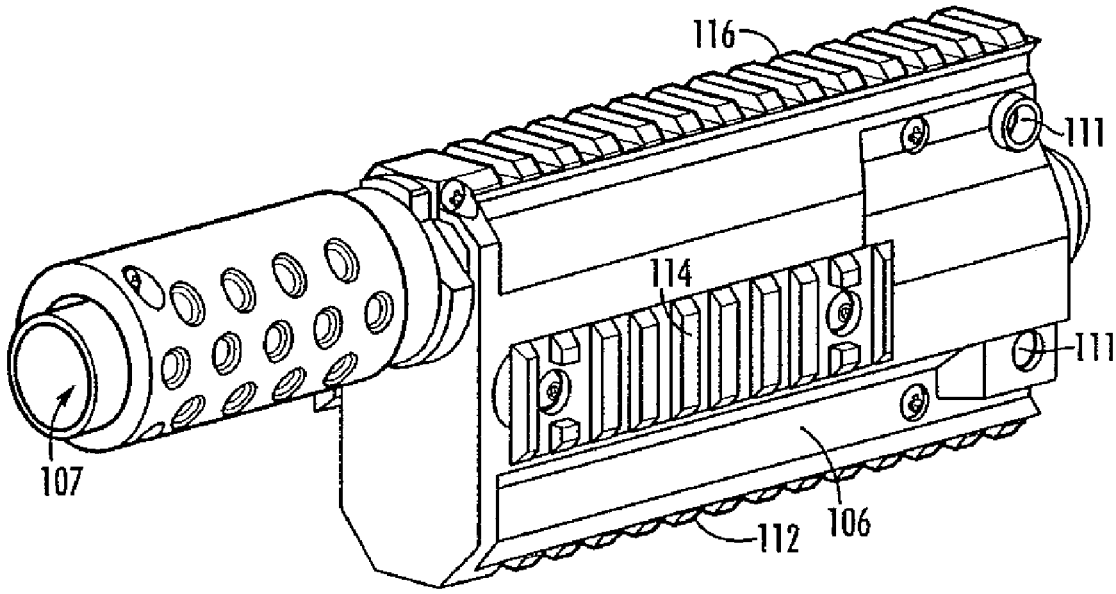
FIG. 11 is a detail perspective view of an alternative forestock that may be used with the example paintball of FIG. 1.
Figure 10A:
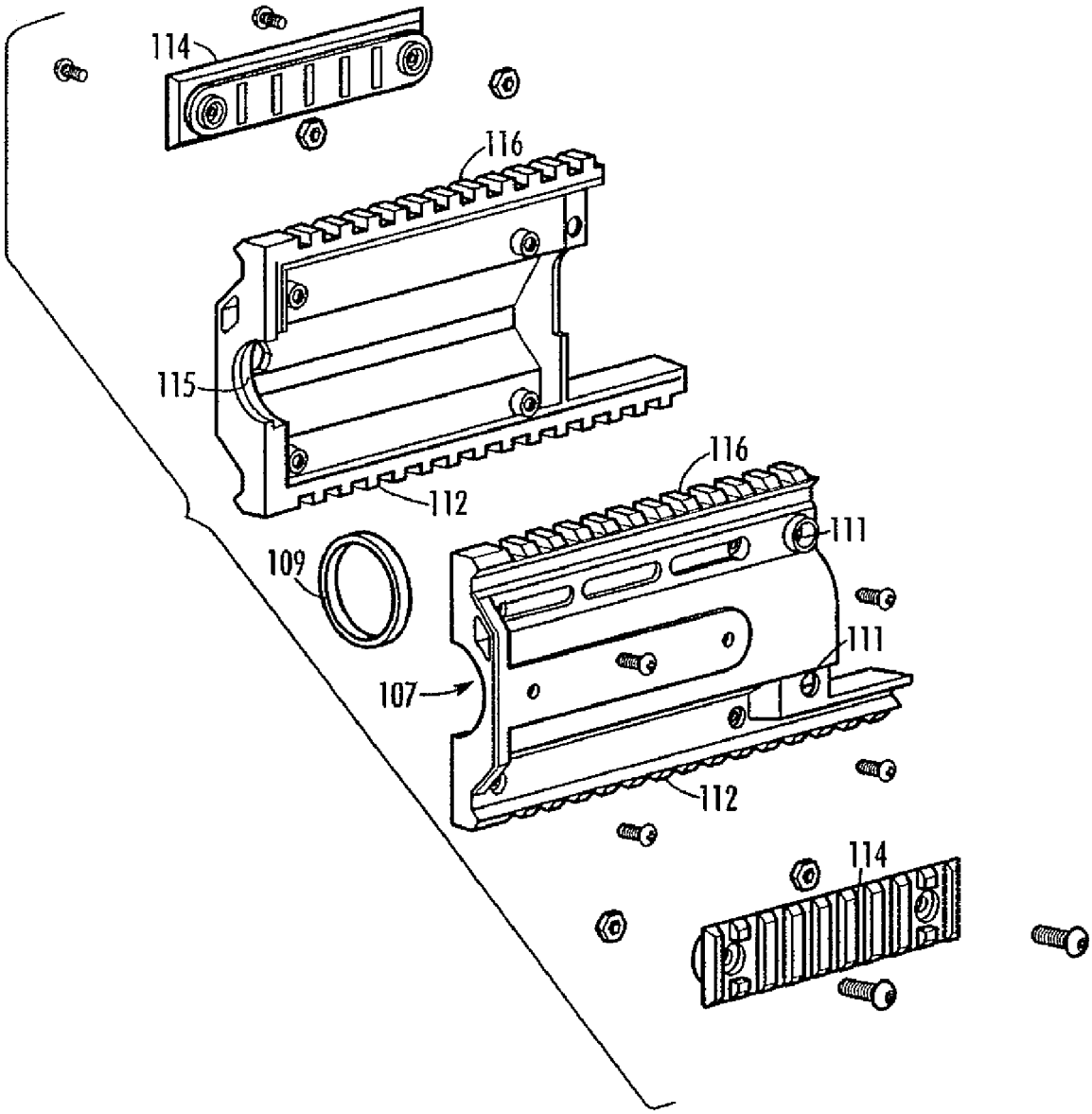
FIG. 10A is an exploded view of the forestock shown in FIG. 10.

In the embodiment shown, the marker 100 includes a forestock 106. As best seen in FIGS. 10 and 10A, the forestock 106 may include a bore 107 dimensioned to receive the barrel 102. Preferably, the forestock 106 may be detachably coupled to the receiver 104. In the example shown, a first pin 108 and a second pin 110 extend through holes 111 in the forestock 106 and holes 113 in the receiver 104 (FIG. 2), thereby coupling the forestock 106 to the receiver 104. In this example, the forestock 106 may be detached from the receiver 104 by removing the pins 108 and 110 and sliding the forestock 106 off the barrel 102. Conversely, a user may mount the forestock 106 to the marker 100 by sliding the forestock 106 over the barrel 102 such that the holes 111 in the forestock 106 and the holes 113 in the receiver 104 are aligned. The pins 108 and 110 may then be moved through the forestock 106 and receiver 104 to couple the forestock 106 to the receiver 104. As best seen in FIG. 7, the pins 108 and 110 may include a bias member 105 to prevent accidental removal of the pins 108 and 110. Although the first pin 108 and second pin 110 are shown for purposes of illustration, it should be appreciated that other quick connections may be used to couple the forestock 106 to the receiver 104.

In some cases, the forestock 106 may be associated with a barrel adapter 109. The barrel adapter 109 (best seen in FIG. 10A) allows a user to configure the marker 100 with barrels of different diameters. Consider a situation in which a user desires to use barrels with either a ⅞ inch diameter or a 1 inch diameter. The bore 107 could be dimensioned to receive the 1 inch barrel. If the ⅞ inch barrel is desired to be used, the user would place the barrel through the adapter 109. In this example, the opening in the adapter 109 would be dimensioned to receive the barrel, which is ⅞ inches in this example. The outer diameter of the adapter 109 would be dimensioned to be received by the bore 107, or 1 inch in this example. As shown, the adapter is received in a recess 115 formed in the forestock 106.

Figure 21A:
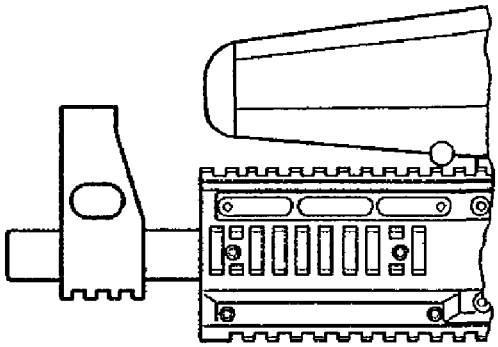
FIGS. 21A-21D show example front sights and handles that may be connected to the marker.
Figure 21B:
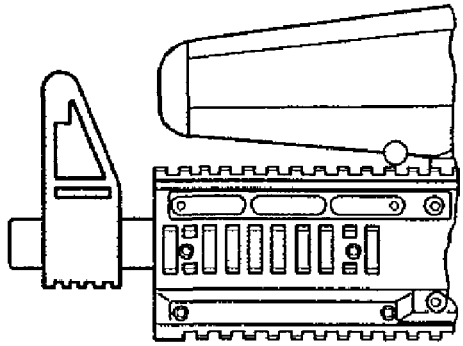
Figure 22:
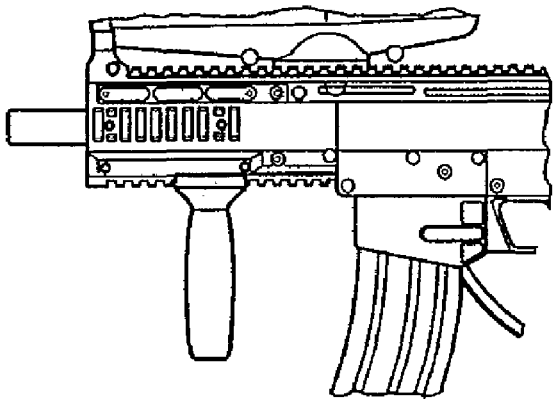
FIG. 22 shows an example vertical handle that may be connected to the marker.

In some embodiments, the forestock 106 may include a bottom rail 112, a side rail 114, and/or a top rail 116 for mounting accessories, such as sites, scopes, etc. In the example shown, the marker 100 includes a front site 118 mounted to the top rail 116. It should be appreciated that the marker 100 could be customized with other types of sites, such as those shown in FIGS. 21A-21B. By way of a further example, a vertical handle, such as shown in FIG. 22, could be attached to the bottom rail 112.

Preferably, the user may select between a plurality of interchangeable forestocks, which each allow a suitable quick connection with the receiver 104 to customize the marker 100. For example, if the receiver 104 includes holes 113, each of the forestocks could include holes 111 to allow a quick connection using pins 108 and 110. Example forestocks that could be used with the marker 100 are illustrated in FIGS. 19A-19E. It should be appreciated that other styles of forestocks could be used with the marker 100.

In some embodiments, the marker 100 may include a tool box 120 for storing one or more items. In this embodiment, the tool box 120 is coupled with and extends from the receiver 104. Typically, the tool box 120 is detachably coupled with the receiver 104; however, the tool box 120 could be integral with or permanently affixed to the receiver 104. Embodiments are also contemplated in which the tool box 120 could be an internal storage compartment in the receiver 104 that could be accessed by a user.

Preferably, the tool box 120 resembles a magazine that feeds projectiles into the receiver. Instead of feeding projectiles into the receiver 104, however, the tool box 120 would typically hold tools for maintaining the marker 100, including but not limited to hex wrenches or a tube of oil. As shown, the tool box 120 includes a slot 122 dimensioned to receive a first supply line 124. In other embodiments, the tool box 120 could include a connection for coupling the first supply line 124. Preferably, the first supply line 124 provides a source of compressed gas for a valve arrangement 178 within the marker 100 (see FIG. 13). In some cases, if the marker 100 were a combustible fuel powered marker, the first supply line 124 may provide a supply of fuel, such as propane, to a combustion chamber within the marker 100.

Figure 12:
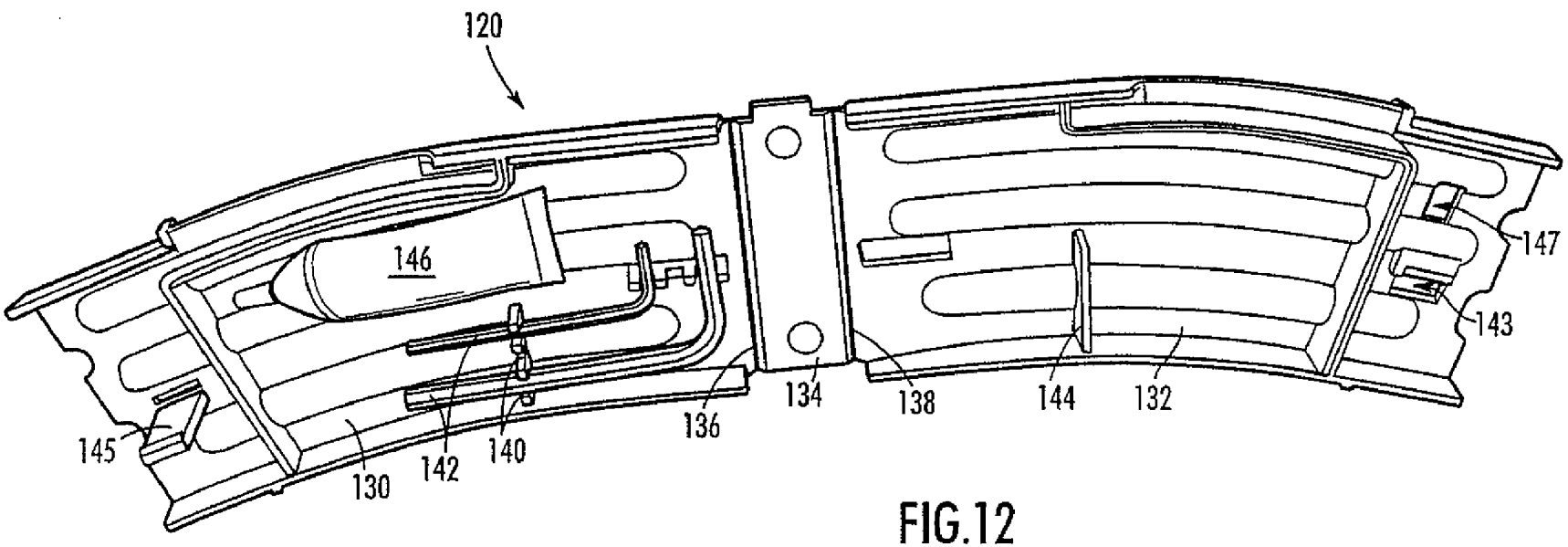
FIG. 12 is a perspective view of an example tool box constructed in accordance with the embodiment of the invention in which the tool box is in an open position to show items disposed therein.

The tool box 120 may include an internal storage compartment for storing items, such as tools. In the example shown in FIG. 12, the tool box 120 includes a first side 130 and a second side 132 pivotally coupled with a bottom 134. Although the embodiment shown includes an open top, the tool box 120 may be entirely closed since projectiles are not fed into the receiver 104 from the tool box 120 in this embodiment.

As shown, the tool box 120 includes a first hinge 136 and a second hinge 138 that allow the first side 130 and second side 132 to pivot, respectively. In this example, the hinges 136 and 138 are living hinges, but separate hinges could be coupled with the sides 130 and 132 and bottom 134 in some cases. It should be appreciated that other pivotal connections could also be used. Although this example shows the tool box 120 hinged at the bottom 134, it should be appreciated that the tool box 120 could be hinged at the sides 130 and 132 or the top or not hinged at all.

In some cases, the tool box's 120 interior may include tool holders configured to receive a specific arrangement of tools (or other items). In the example shown, the tool box 120 includes slots 140 dimensioned to receive hex wrenches 142 in the first side 130 of the tool box 120. The second side 132 includes complementary ridges 144 configured to close the slots 140 when the tool box 120 is closed, thereby holding the wrenches 142 in place. In this example, the first side 130 of the tool box 120 also includes an area for a tube of oil 146 that could be used to maintain the marker 100. It should be appreciated that the internal cavity of the tool box 120 could be configured to hold a variety of tools, accessories, or other items.

In the example shown, the tool box 120 includes an opening 143 dimensioned to receive an internal latch 145 when the tool box 120 is closed. In this example, the tool box 120 includes an opening 147 dimensioned to receive a latch mechanism in a tool box mount 121 for detachably coupling the tool box 120 to the receiver 104.

Referring again to FIGS. 1-9, the marker 100 preferably includes a tool box mount 121 configured to receive the tool box 120. As shown, the tool box mount 121 includes a release button 123 (best seen in FIG. 5) that controls a latch mechanism associated with the tool box mount 121. In the example shown, the latch mechanism engages the opening 147 in the tool box 120 to selectively release the tool box 120 from the tool box mount 121. It should be appreciated that a variety of mechanisms could be used to detachably couple the tool 120 with the tool box mount 121, such as an interference fit, frictional fit, magnets, etc.

Figure 1:
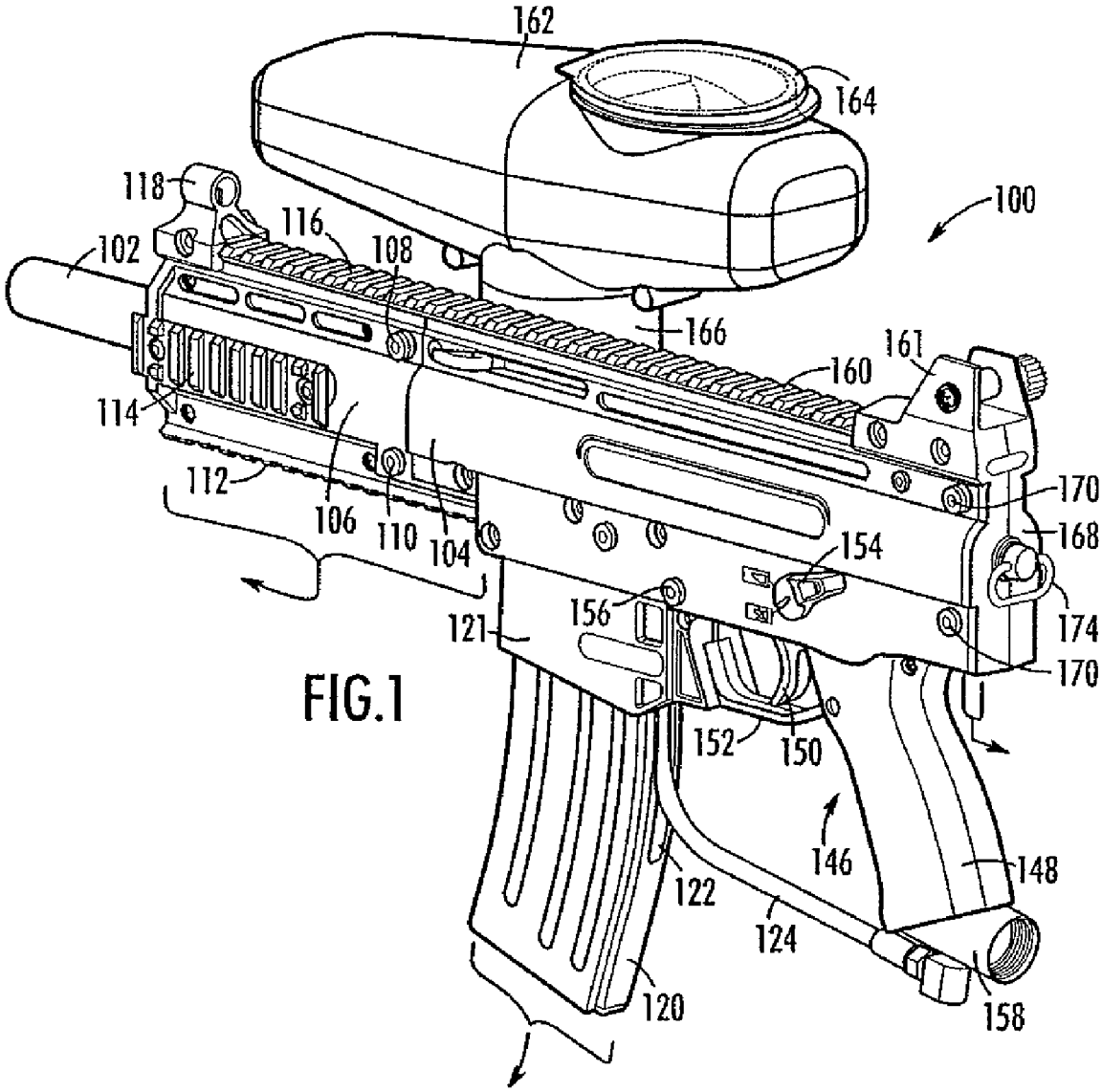
FIG. 1 is a perspective view of an example paintball marker constructed according with an embodiment of the present invention.
Figure 2:
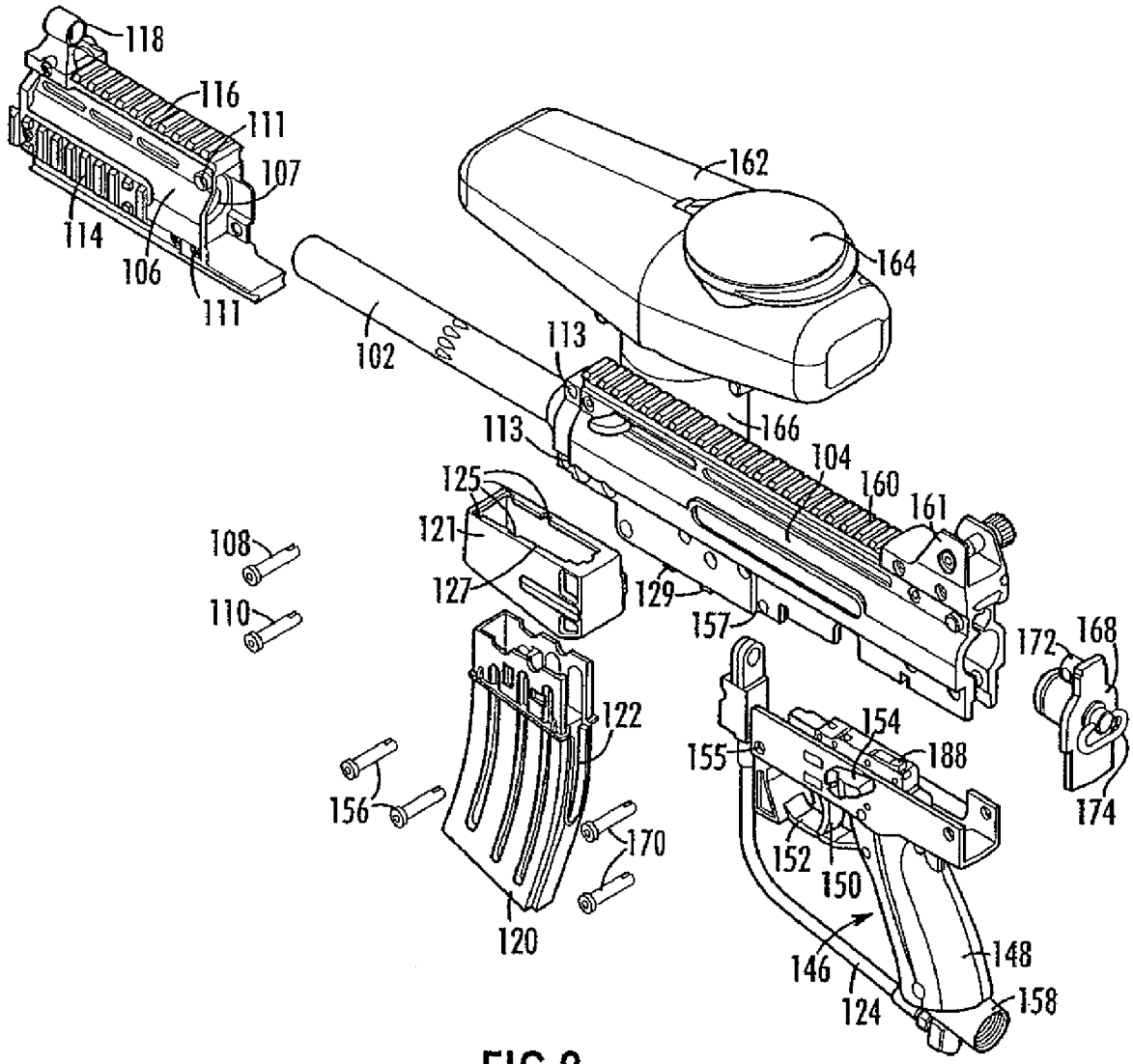
FIG. 2 is an exploded view of the example paintball marker shown in FIG. 1.
Figure 3:
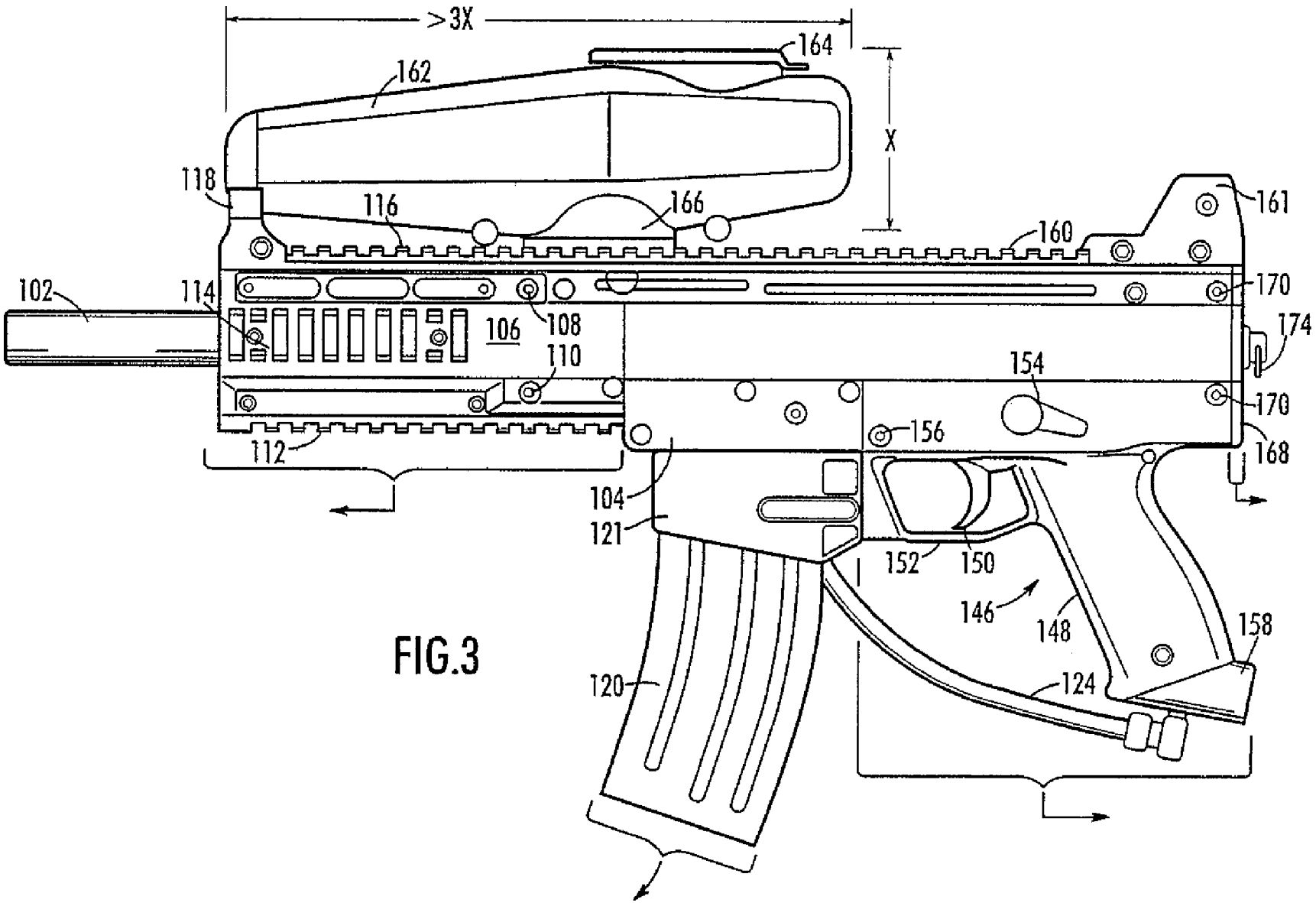
FIG. 3 is a left side view of the example paintball marker shown in FIG. 1.
Figure 4:
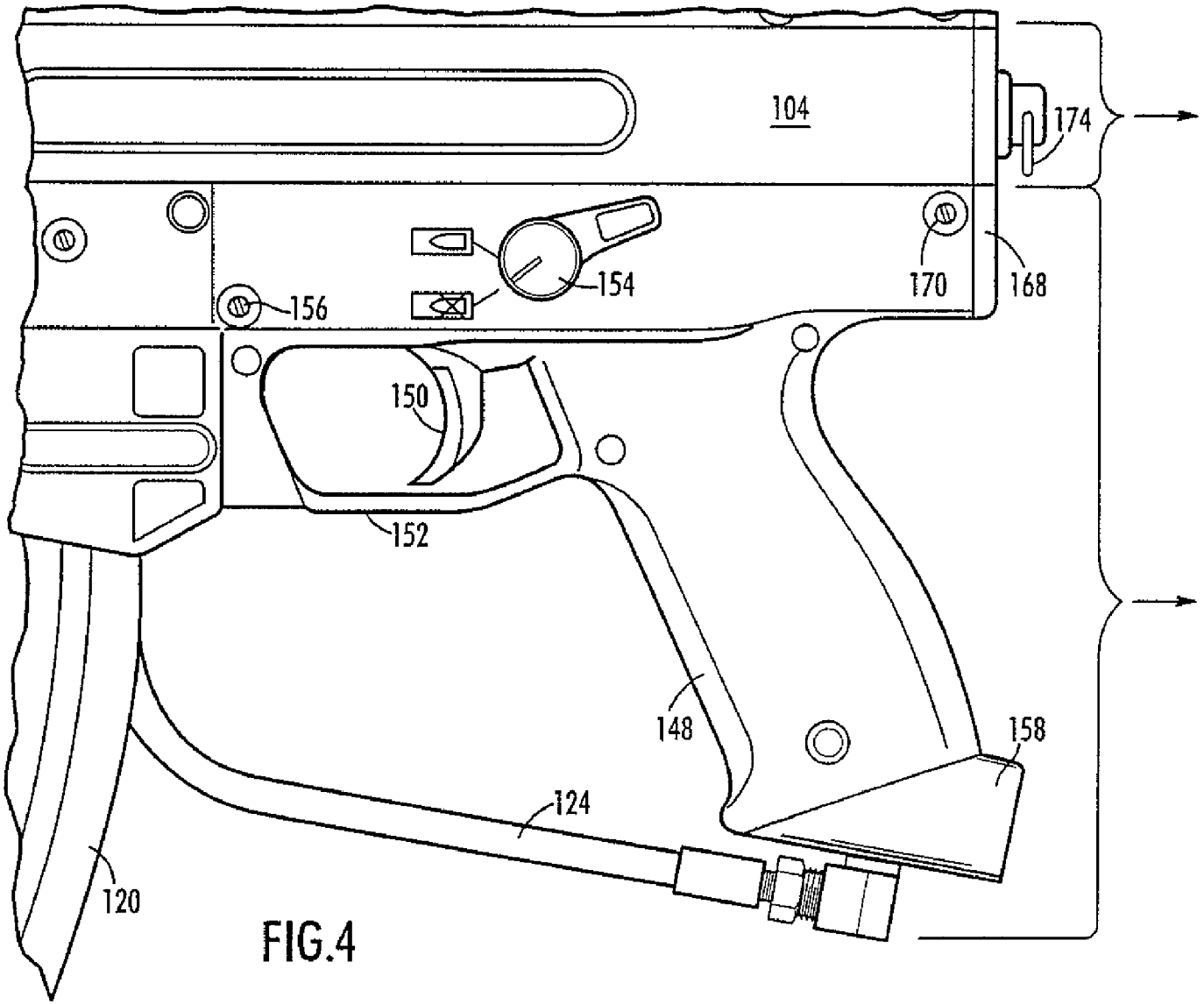
FIG. 4 is a detailed view of the grip assembly for paintball marker shown in FIG. 1.
Figure 5:
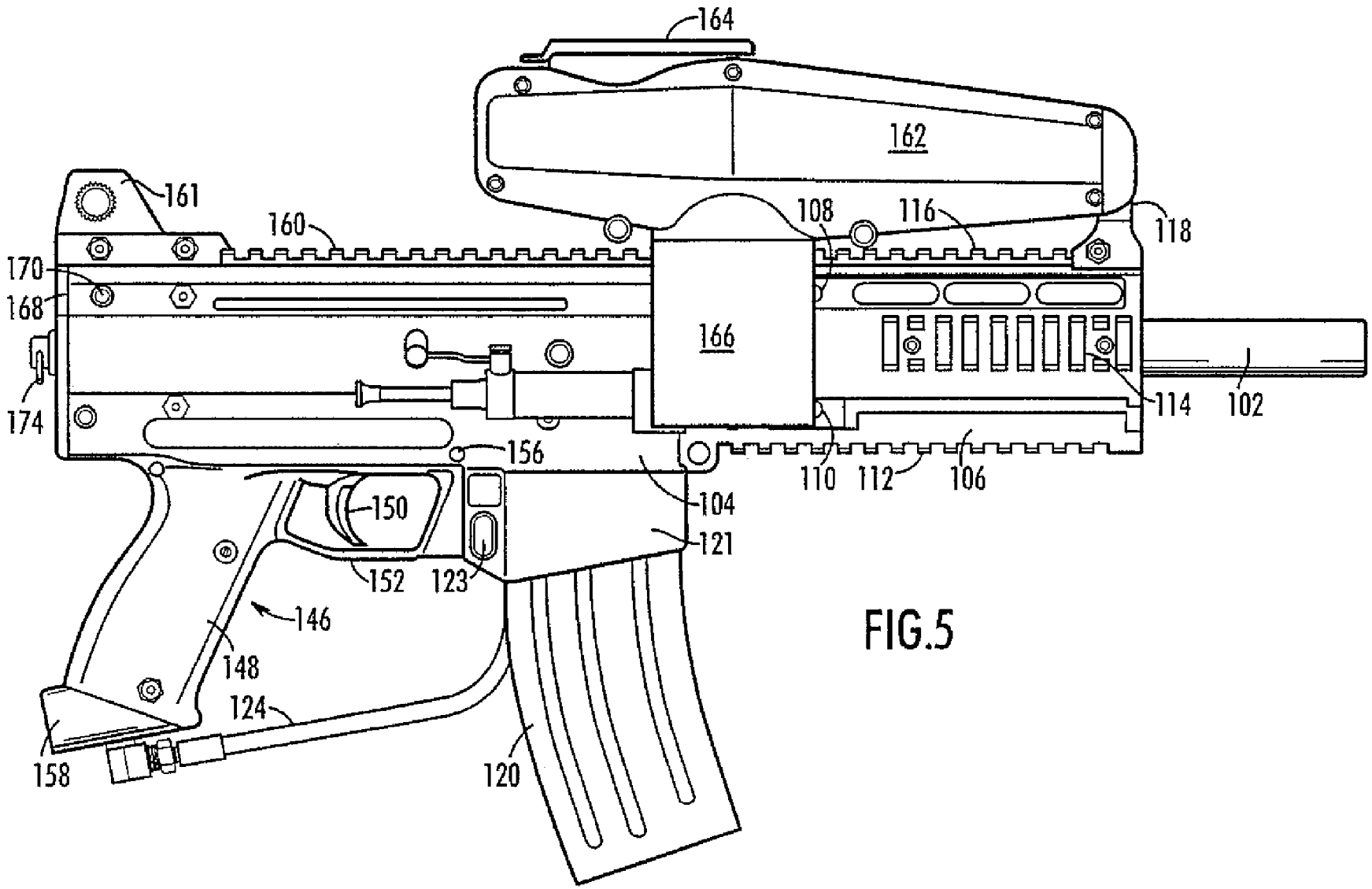
FIG. 5 is a right side view of the example paintball marker shown in FIG. 1.
Figure 6:
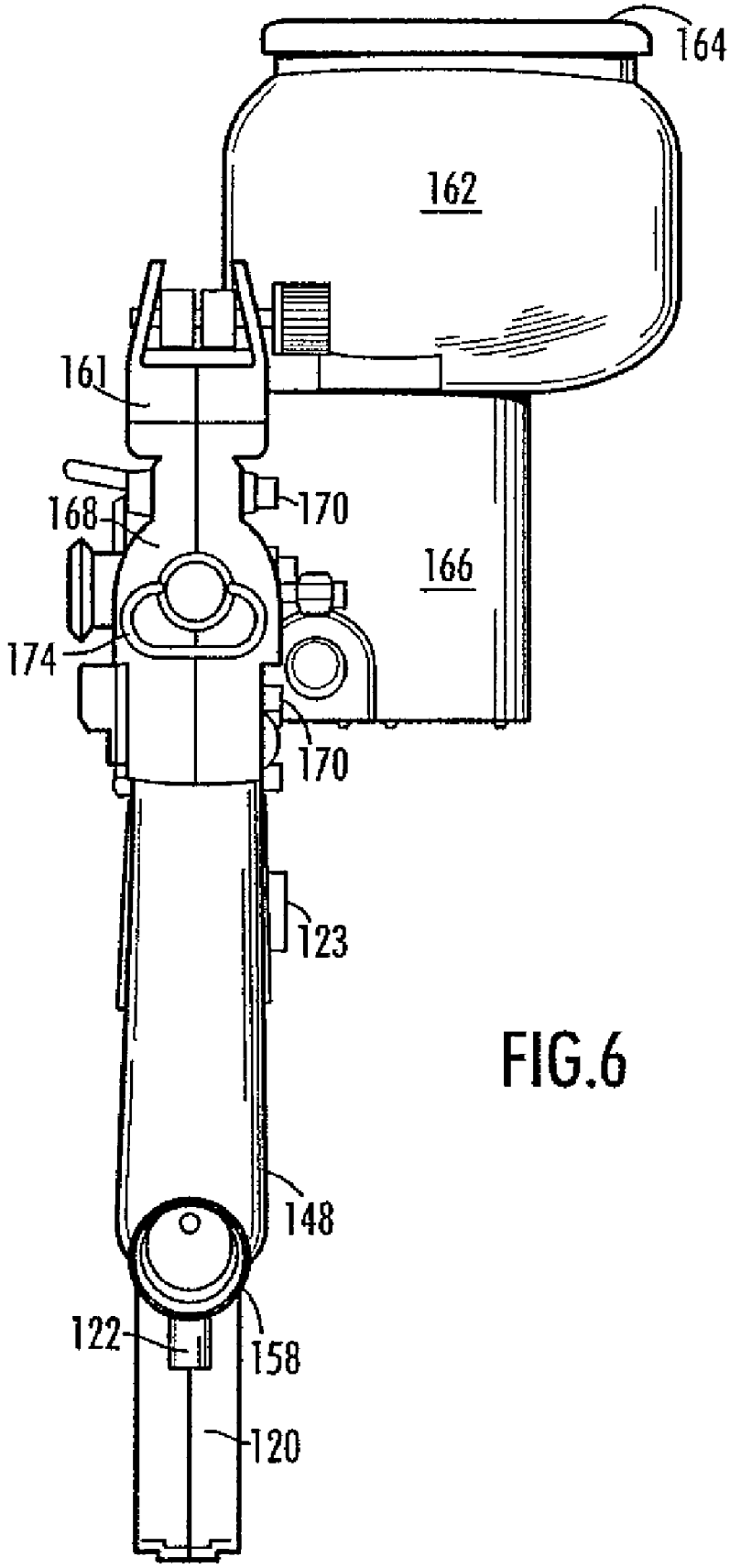
FIG. 6 is a rear view of the example paintball marker shown in FIG. 1.

In the example shown (as best seen in FIG. 2), the tool box mount 121 is coupled with the receiver 104 using an interference fit. As shown, the receiver 104 includes ridges 129 that extend from the receiver 104. The top portion of the tool box mount 121 includes grooves 125 formed in a flange 127 that are configured to receive the ridges 129. To couple the tool box mount 121 to the receiver 104, the user would align the grooves 125 with the ridges 129, such that the ridges 129 extend through the grooves 125. The tool box mount 121 may then be moved toward the barrel 102 in the example shown such that the flange 127 creates an interference fit with the ridges 129. The user may detach the tool box mount 121 by moving the tool box mount 121 in an opposite direction (away from the barrel 102 in this example) until the ridges 129 are aligned with the grooves 125. Other mechanisms, such as a frictional fit, could also be used to couple the tool box mount 121 with the receiver 104.

Preferably, a plurality of interchangeable tool boxes and tool box mounts may be provided to allow customization of the marker 100. Typically, each of the tool boxes includes an interior cavity for storing items, such as tools. Examples of tool boxes that resemble magazines of types used for feeding projectiles into the receivers of actual firearms are shown in FIGS. 20A-20E. It should be appreciated that other styles could also be provided. The tool box 120 may be formed from a variety of materials, including but not limited to plastic, aluminum and magnesium.

The marker 100 may include a grip assembly 146. In the example shown, the grip assembly 146 includes a grip 148 that is dimensioned for a user to grasp. The grip assembly 146 includes a trigger 150 for actuation by the user to fire the marker 100. The trigger 150 may mechanically and/or electrically selectively fire the marker 100. In the example shown, the trigger 150 is surrounded by a trigger guard 152. As shown, the marker 100 includes a safety 154. In the position shown in FIG. 1, the safety 154 prevents the marker 100 from firing; if moved to a fire position, the safety 154 allows the marker 100 to fire projectiles. Although the example shown includes a lever for actuating the safety 154, it should be appreciated that other forms of safety could be used.

In some embodiments, the grip assembly 146 may be detachably coupled with the receiver 104. As shown, the grip assembly 146 includes a hole 155 that is alignable with a hole 157 in the receiver 104 through which a pin 156 may be received. By removing the pin 156 (and the lower pin 170), the grip assembly 146 may be detached from the receiver 104. In the example shown, the lower portion of the grip 148 includes an adaptor 158 configured to receive a propellant source, such as a canister of carbon dioxide or nitrogen. As discussed below, the adaptor 158 and first supply line 124 are optional, depending on whether the rear stock attached to the receiver 104 includes an internal passageway 186 for connection to a propellant source (See FIGS. 15-16).

Figure 21C:
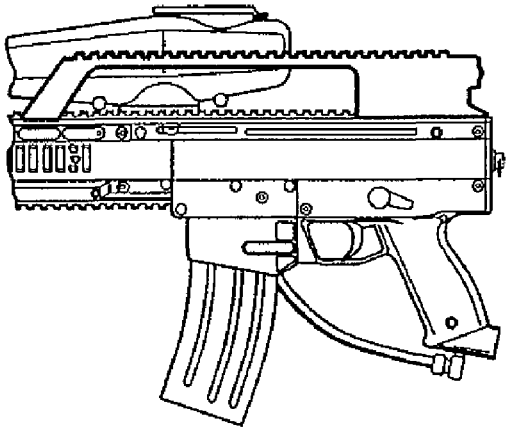
Figure 21D:
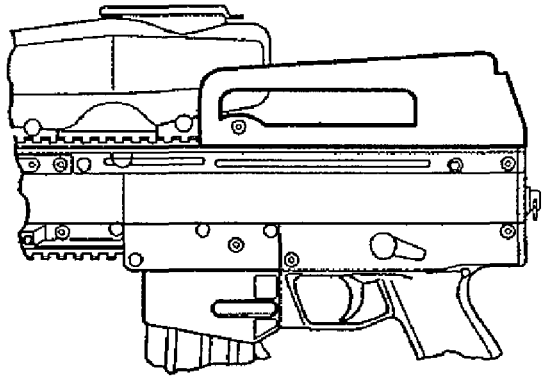

In the example shown, a picatinny rail 160 is attached to a top portion of the receiver 104. The picatinny rail 160 may be used to add risers, sites, handles, or other items to the receiver 104. As shown, a rear sight 161 is coupled to the picatinny rail 160. By way of another example, carry handles, such as shown in FIGS. 21C-21D, could be mounted to the picatinny rail 160.

In the embodiment shown, the marker 100 includes a hopper 162 for holding a plurality of projectiles to be fired. As shown, the hopper 162 includes a lid 164 pivotably mounted to the hopper 162 to selectively open/close an opening to the hopper 162. Preferably the hopper 162 has a low profile to reduce the target area of the user and allow a better line of site to fire the marker 100. By way of example only, the hopper 162 may have a length that is more than three times its height in some cases (see FIG. 3). As shown, the hopper 162 is offset from the receiver 104 to allow a better line of site for the user to fire the marker 100. However, the hopper 162 could be coupled to the receiver 104 on the top (e.g., picatinny rail 160) or other location of the receiver 104.

In some cases, the hopper 162 may be coupled with a feed mechanism 166 that feeds projectiles into the receiver 104. An example feed mechanism that could be used with the marker 100 is shown in U.S. Pat. No. 6,739,323, which is incorporated herein by reference.

Instead of a separate feed mechanism, the hopper 162 may include an integral feed mechanism in some embodiments. For example, the hopper 162 may be an agitating or force-fed hopper. In some cases, the projectiles may be gravity fed into the receiver 104. For example, the lower portion of the hopper 162 may include a passage that is coupled directly with the receiver 104, so that projectiles may be fed one-by-one through the passage into the receiver 104. In some embodiments, the receiver 104 (or other portion of the marker 100) may include an internal cavity for receiving a plurality of projectiles. By way of another example, the receiver 104 may be stick fed with projectiles.

Figure 18A:
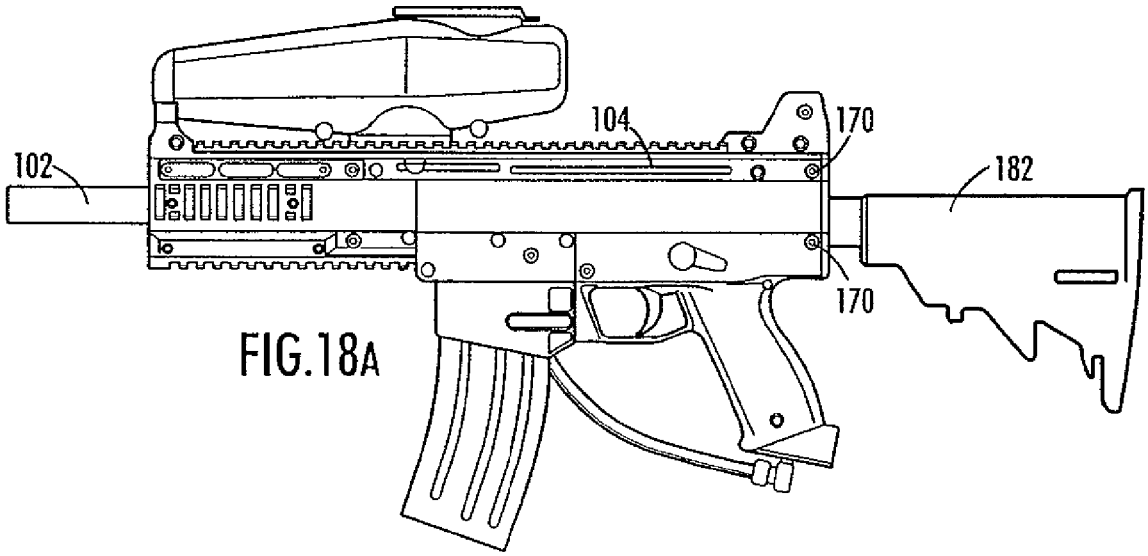
FIGS. 18A-18C show example rear stocks that may be attached to the marker.
Figure 18B:
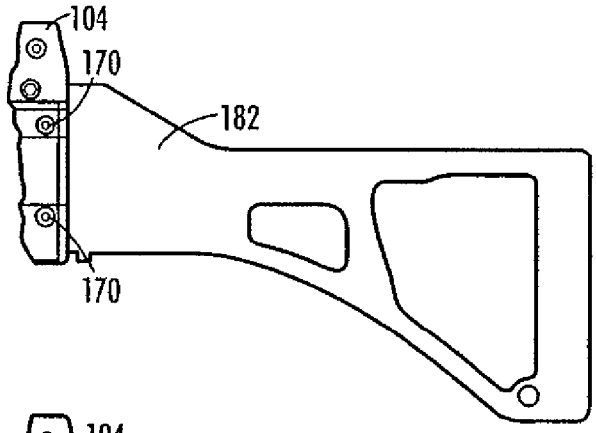
Figure 18C:
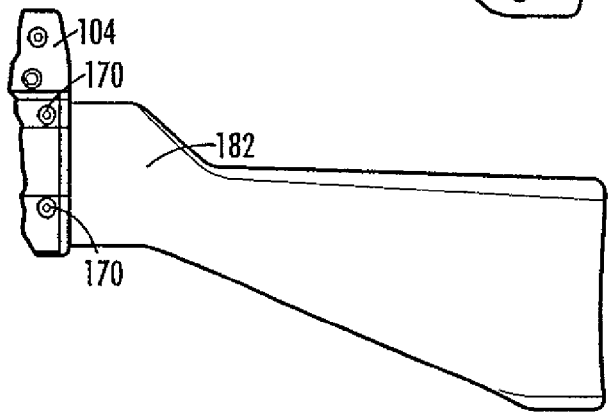
Figure 19A:
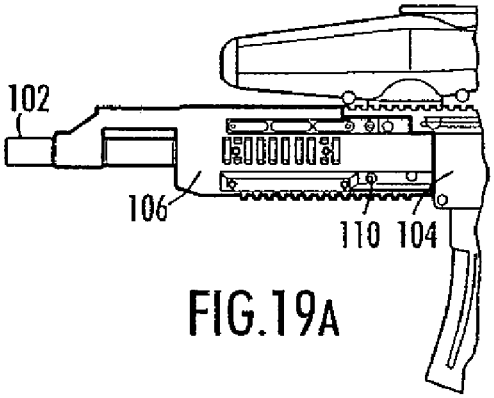
FIGS. 19A-19E show example forestocks that may be attached to the marker.
Figure 19B:
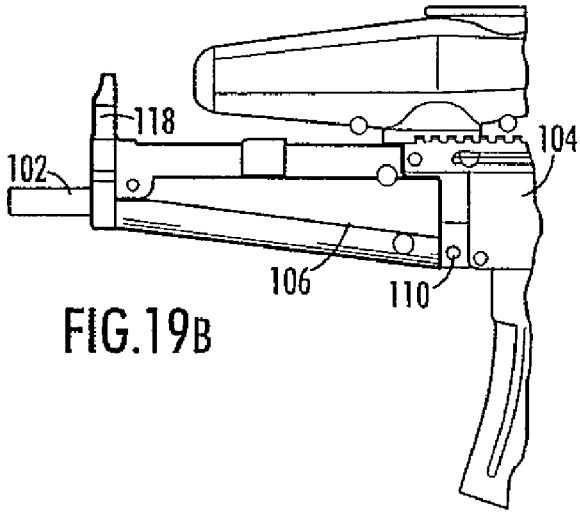
Figure 19C:
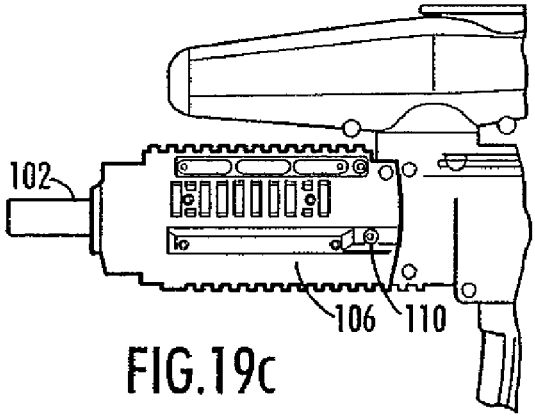
Figure 19D:
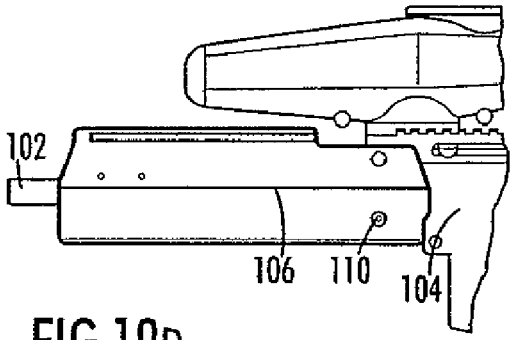
Figure 19E:
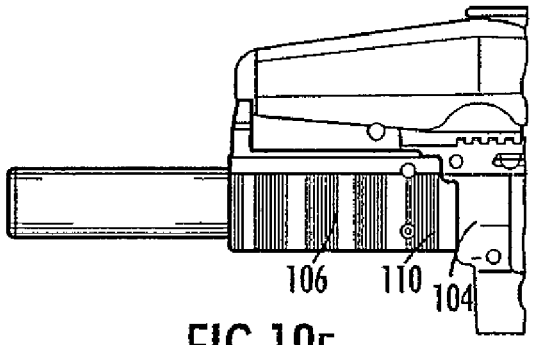
Figure 20A:
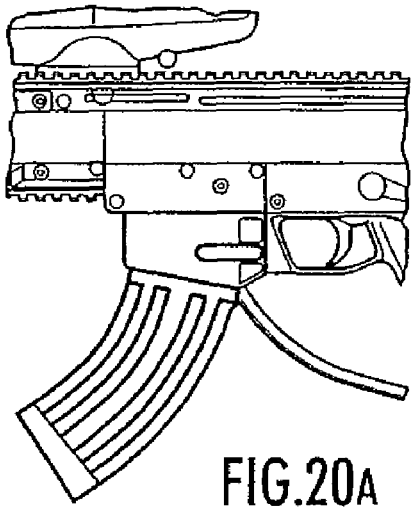
FIGS. 20A-20E show example tool boxes that resemble magazines.
Figure 20B:
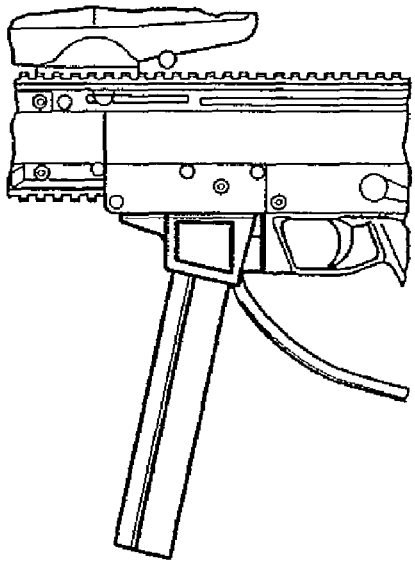
Figure 20C:
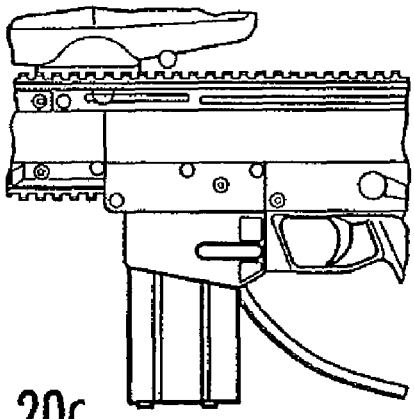
Figure 20D:
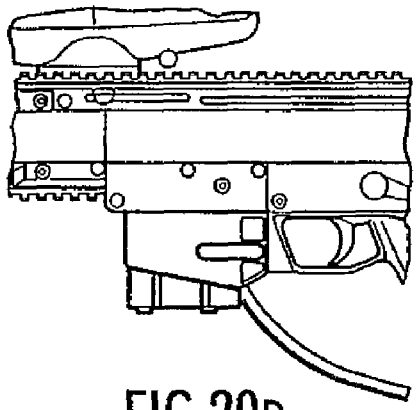
Figure 20E:
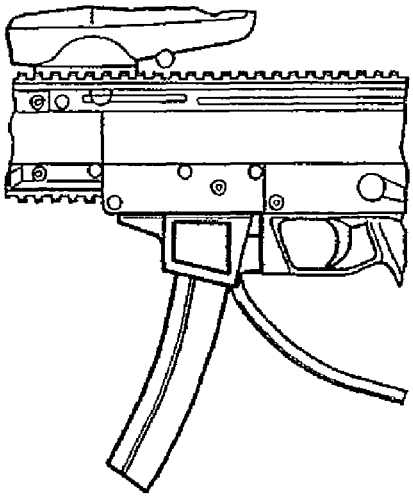

In the embodiment shown in FIGS. 1-9, the marker 100 includes a detachable end cap 168. If the user desires to have a rear stock, the end cap 168 may be removed and a rear stock coupled to the receiver 104 (see FIGS. 14-16). In the example shown, pins 170 pass through projections 172 (see FIGS. 2 and 13) in the end cap 168 and holes in the receiver 104 and grip assembly 146. Removal of the pins 170 allows the user to detach the end cap 168 from the receiver 104. In the example shown, the end cap 168 includes an optional ring 174 that user may grasp to remove the end cap 168. As discussed below, a plurality of interchangeable rear stocks may be substituted for the end cap 168 to customize the marker 100. Preferably, each of the rear stocks include similarly arranged holes such that the rear stocks may be attached to the receiver 104 using the pins 170. Examples of rear stocks that could be used with the marker 100 are shown in FIGS. 18A-18C.

Figure 13:
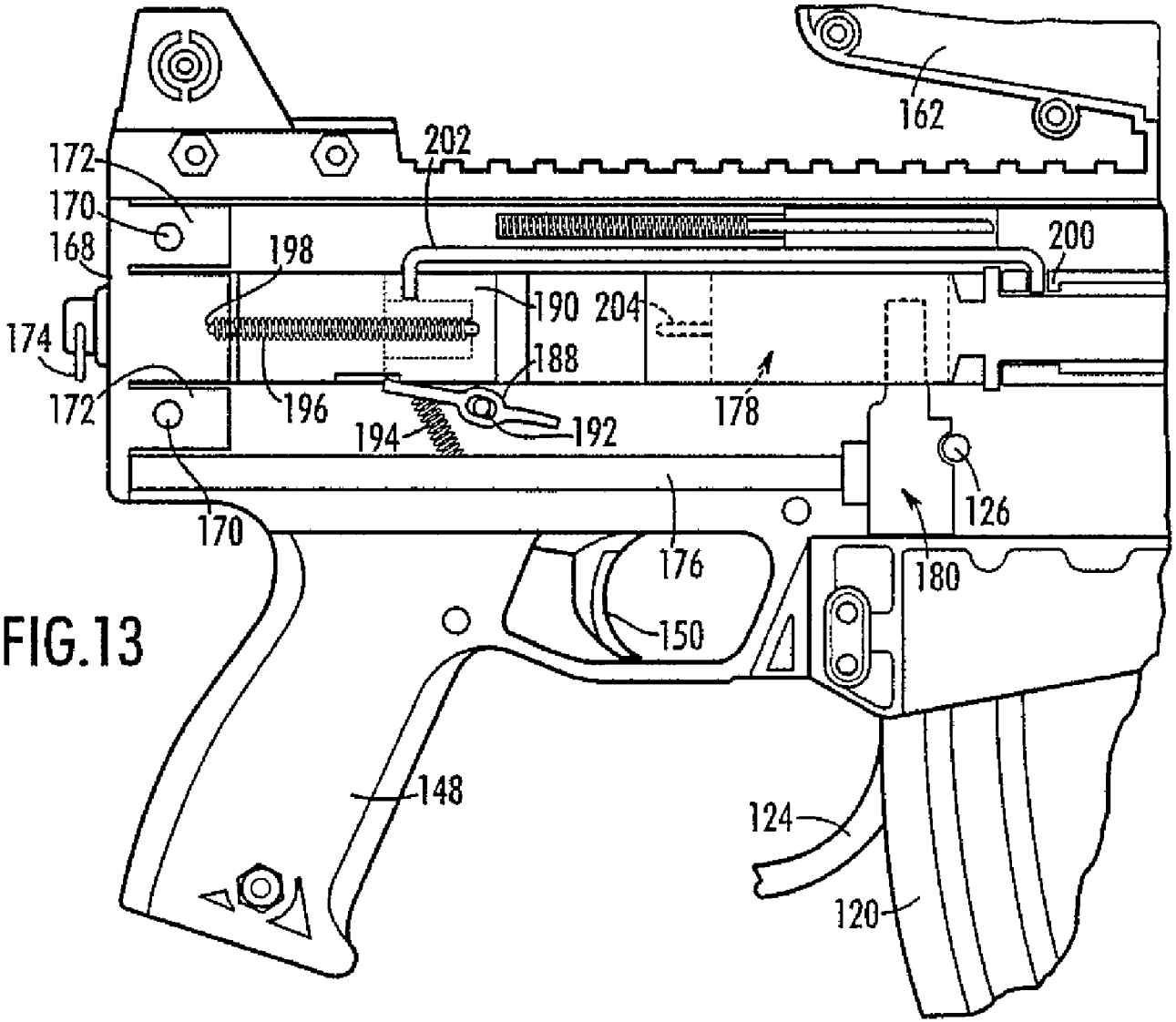
FIG. 13 is a side cross-sectional view showing the first and second supply lines in the example paintball marker of FIG. 1.

Referring now to FIG. 13, there is shown a detailed cross-sectional view of the marker 100. As shown, a sear 188 is interposed between the trigger 150 and a 190. In this example, the sear 188 is disposed on pivot pin 192 and is biased by spring 194 toward engagement of the rear bolt 190. When the marker 100 is in the cocked position, actuation of the trigger 150 releases the rear bolt 190 from the sear 188. In the example shown, the marker 100 is in the cocked position when the rear bolt 190 is in a rearward position in which the sear 188 prevents forward movement of the rear bolt 190. In the example shown, the marker 100 moves to a discharge position by releasing of the rear bolt 190 from the sear 188 due to user actuation of the trigger 150. It should be appreciated that other trigger assemblies, both mechanical and electrical, may be suitable to selectively fire the marker 100 and are contemplated herein.

In the example shown, the rear bolt 190 moves under the bias of drive spring 196 upon actuation of the trigger 150. A pin 198 is disposed within the spring 196 in the example shown. The rear bolt 190 is coupled to a front bolt 200 via a linkage arm 202 in the example shown. This causes concomitant movement of the front bolt 200 with the movement of the rear bolt 190. The front bolt 200 is adapted to push a projectile into the barrel 102 during firing.

The bias of drive spring 196 on rear bolt 190 causes rear bolt 190 to depress an impact pin 204 on the valve assembly 178, which causes the valve assembly 178 to release a quantity of compressed gas, thereby causing a projectile to be propelled out the barrel 102. Another quantity of compressed gas may be released on the side of valve assembly 178 in which the rear bolt 190 is disposed, which will recoil the rear bolt 190 to the cocked position. Example valve arrangements and firing mechanisms that could be used are shown and described in U.S. Pat. Nos. 4,189,609, 5,722,383, and 6,550,468, which are each hereby incorporated by reference.

In the embodiment shown, a second supply line 176 can be seen. Preferably, the marker 100 may be configured such that either the first supply line 124 or the second supply line 176 may supply the valve arrangement 178 with a propellant with which the projectiles may be fired. Preferably, the first supply line 124 or the second supply line 176 provides compressed gas, such as carbon dioxide or nitrogen, to the valve arrangement 178. As discussed above, however, the supply lines 124 or 176 could provide fluid communication with a supply of combustible fuel in some embodiments.

In this example, the marker 100 includes a coupling 180 associated with the first supply line 124. Typically, the user would choose between the first supply line 124 and the second supply line 176. If the user decided to use the first supply line 124, the user would put the first supply line 124 and coupling 180 associated with the first supply line 124 into the receiver. This would supply compressed gas to the valve arrangement 178 via the first supply line 124. A passageway is defined in the receiver 104 for receiving the second supply line 176. Preferably, the passageway extends from the valve arrangement to the rear portion of the receiver 104 so that the second supply line 176 may be aligned with a passage with a rear stock which is in fluid communication with a supply of compressed gas. If the user desired to use the second supply line 176, the first supply line and associated coupling 180 would typically be removed and the second supply line and an associated coupling 180 inserted into the passageway. The coupling 180 provides the valve arrangement 178 with a supply of compressed gas from the first supply line in the example shown.

In some cases, the coupling 180 may be configured to receive both the first supply line 124 and the second supply line 176. For example, the coupling 180 may include a first check valve (not shown) at the inlet of the first supply line 124 into the coupling 180 and a second check valve (not shown) at the inlet of the second supply line 176 into the coupling 180. With this arrangement, the inlets would only be open due to the supply of compressed gas to open a respective check valve. It should be appreciated that other mechanisms, both mechanical and electrical, could be used to selectively supply the valve arrangement 176 with a flow of compressed air from either the first supply line 124 or the second supply line 176. In some embodiments, the coupling 180 could be configured to supply compressed air from both the first supply line 124 and the second supply line 176. In the example shown in FIG. 13, the second supply line 176 does not supply compressed gas to the valve arrangement 178 due to the end cap 178 being connected to the receiver 104. As discussed below, the second supply line 176 may continue flow through the rear stock, which may be connected with a source of compressed gas.

Figure 14:
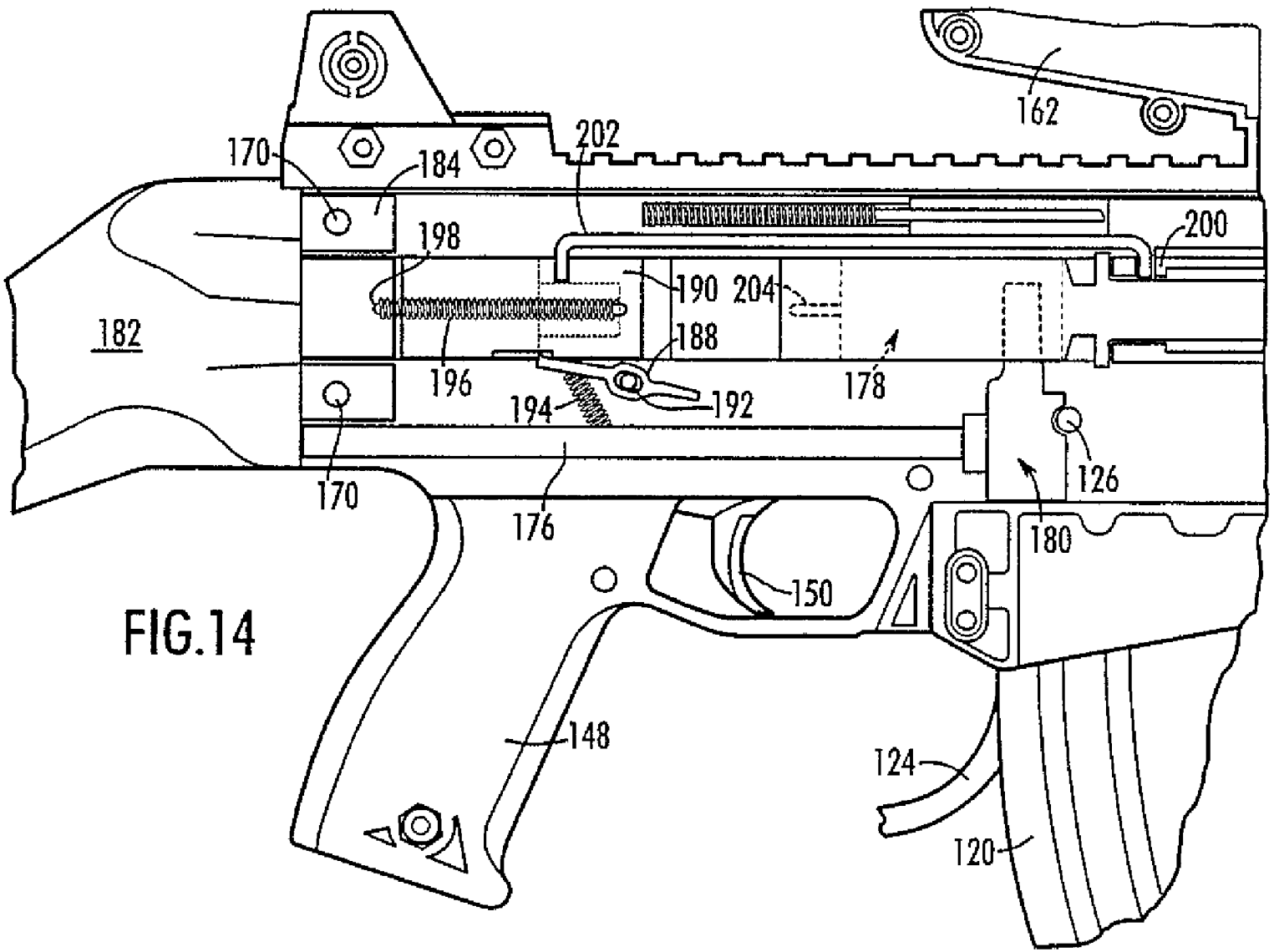
FIG. 14 is a side cross-sectional view showing the second supply line portion of the example paintball marker shown in FIG. 1, with an example rear stock attached to the marker.

FIG. 14 shows an example in which a rear stock 182 has been coupled with the receiver 104. In the example shown, the rear stock 182 includes a projection 184 with holes dimensioned to receive the pins 170. Accordingly, a user may customize a marker 100 with a plurality of interchangeable rear stocks that may be coupled to the receiver 104. Examples of rear stocks that may be coupled to the marker 100 are shown in FIGS. 18A-18C. It should be appreciated that other types of rear stocks could also be provided.

Figure 15:
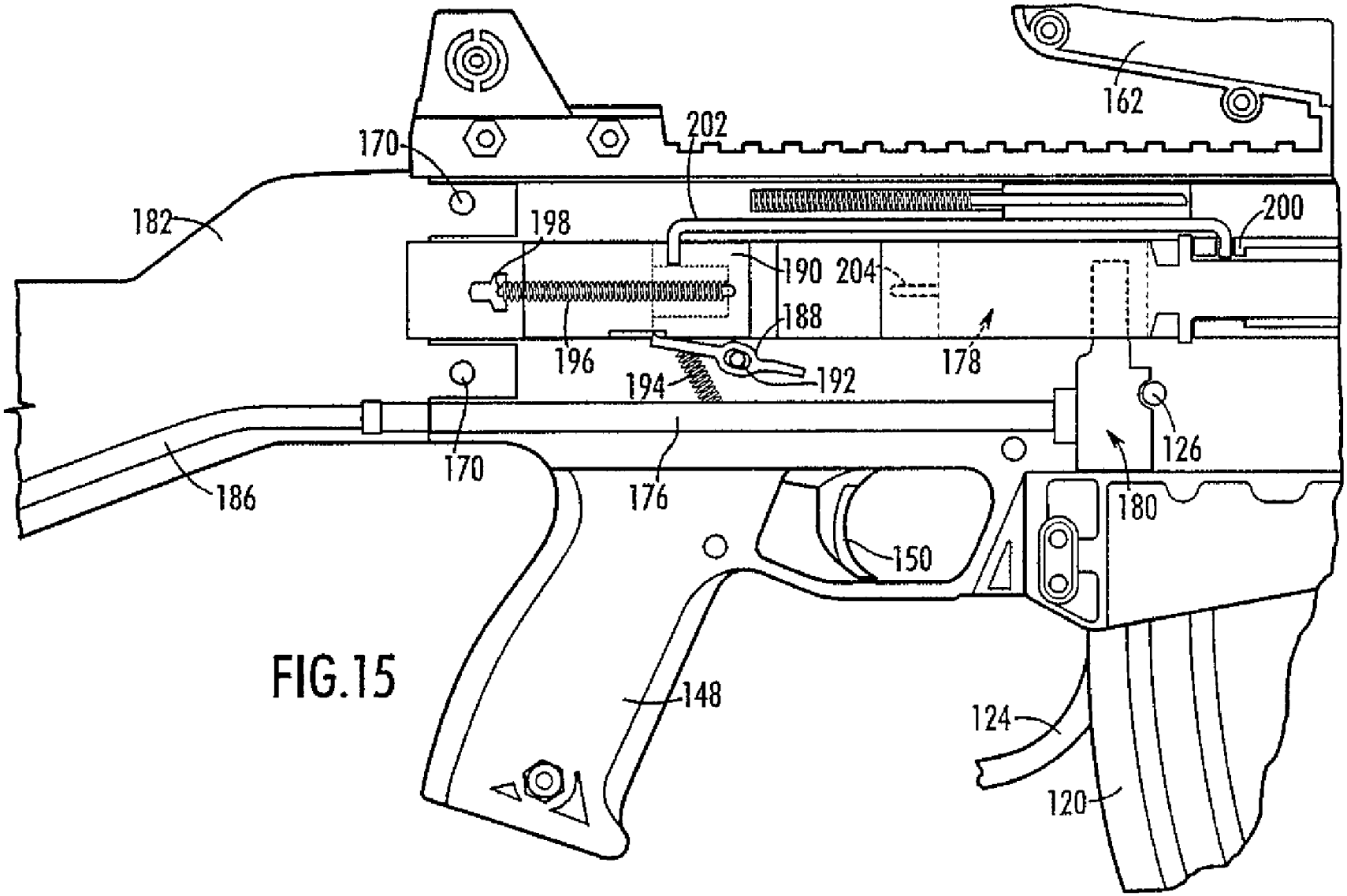
FIG. 15 is a cross-sectional view of the example paintball marker shown in FIG. 14, with a cross-sectional view of an example rear stock attached to the marker.
Figure 16:
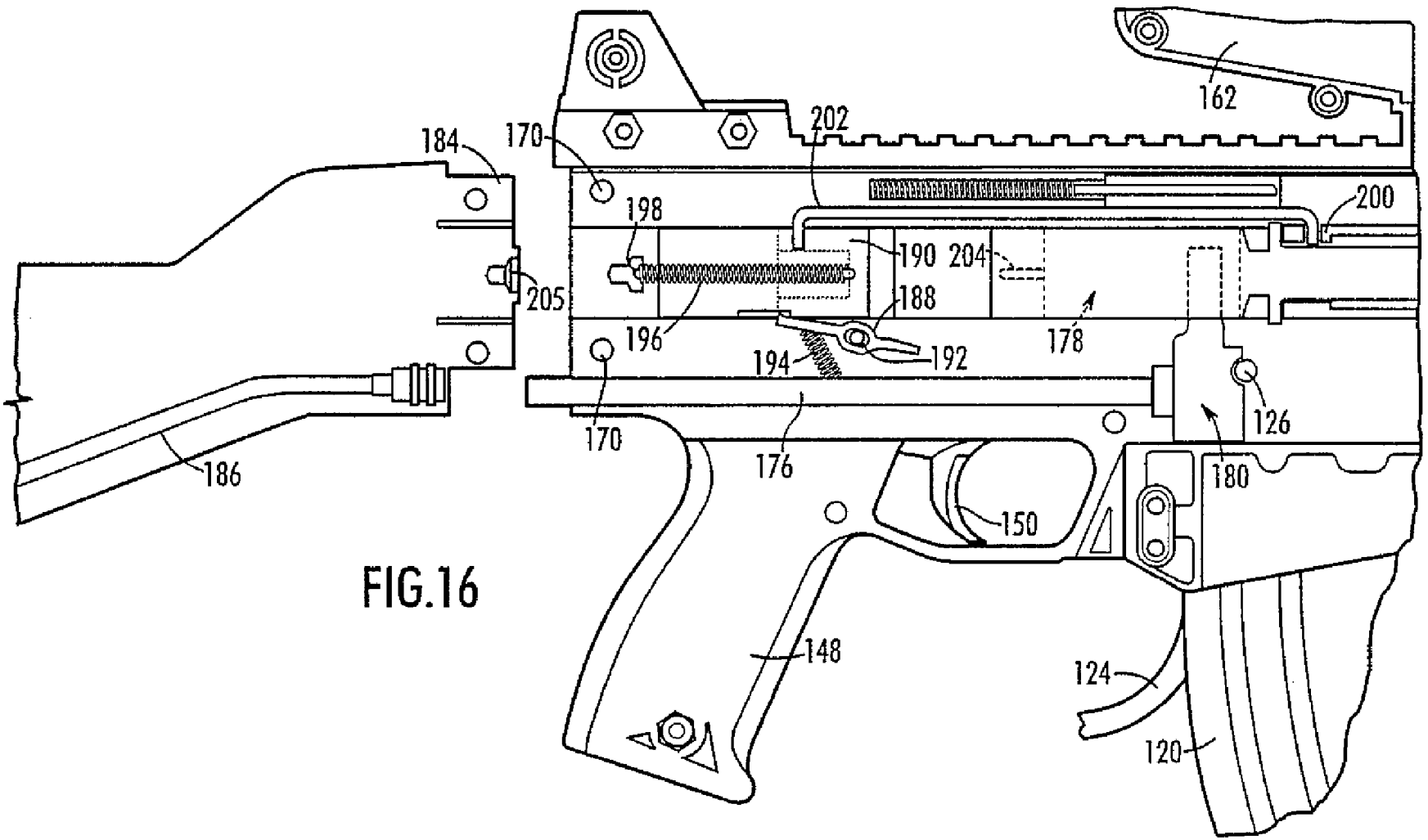
FIG. 16 is a cross-sectional view of the example paintball marker shown in FIG. 15, with the rearstock detached from the marker.

FIGS. 15-16 show the example embodiment of FIG. 14 with the rear stock 182 shown in sectional view. As shown, the rear stock 182 includes a passageway 186 that is in fluid communication with the second supply line 176. The passageway 186 may be in fluid communication with the supply of compressed gas (or other propellant), thereby providing compressed gas to the valve arrangement 178. In some cases, the rear stock 184 may include a recess 205 for receiving an end of the pin 198.

Figure 17:
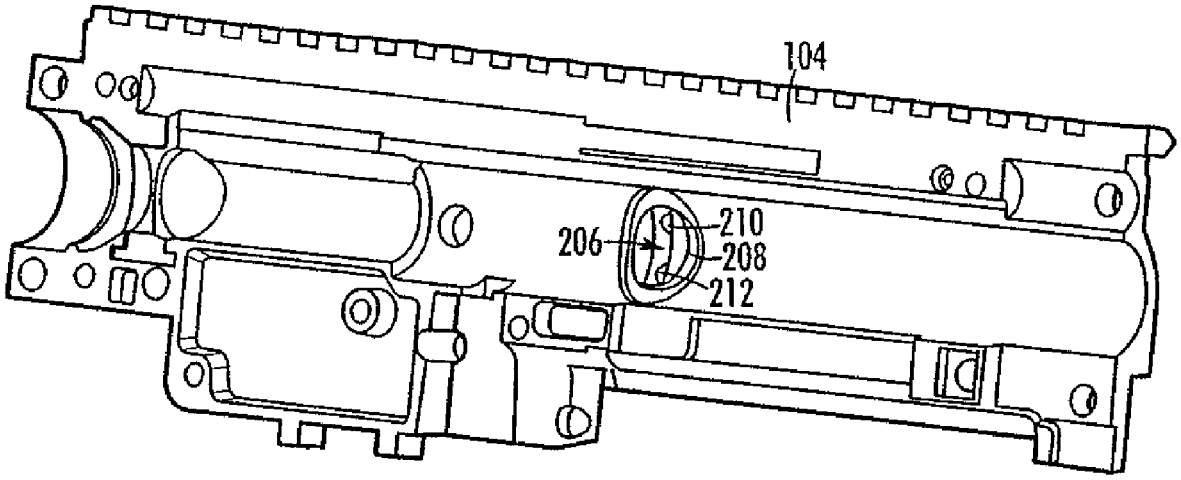
FIG. 17 is a detailed perspective view of a portion of a receiver according to an alternative embodiment.

FIG. 17 shows the right half of an example receiver 104. Although the example receiver 104 shown includes holes that could be used for quick connections of rear stocks, fore stocks, etc., this receiver 104 could also be used with a marker without such customization features. In some cases, the valve assembly 178 may be tapped to supply compressed gas for other functions associated with the marker 100. For example, the feed mechanism 166 could be pneumatically actuated with compressed gas tapped off the valve assembly. For example, U.S. Pat. No. 6,739,323 shows a feed mechanism that may be pneumatically actuated. By way of another example, U.S. Pat. No. 6,550,468 shows a trigger assist that may be pneumatically actuated, In receivers formed by two halves that are connected together, such as the example half shown, gas that is tapped off the valve assembly 178 tends to escape through the seam between the halves of the receiver 104.

In the example shown, the receiver 104 includes a groove 206 dimensioned to receive a seal 208, such as an O-ring. Preferably, the groove 206 is substantially elliptical is shape, which retains the seal 208 without a fastener or adhesive. The groove 206 and seal 208 are disposed within the receiver 104 preferably adjacent the portion of the valve assembly 178 that is tapped to prevent escape of gas through the seam in the receiver 104. As shown, a first outlet port 210 and a second outlet port 212, which are associated with tapped portions of the valve assembly 178, are disposed within the groove. Additionally outlet ports (or a single outlet port) may be provided.

Figure 23:
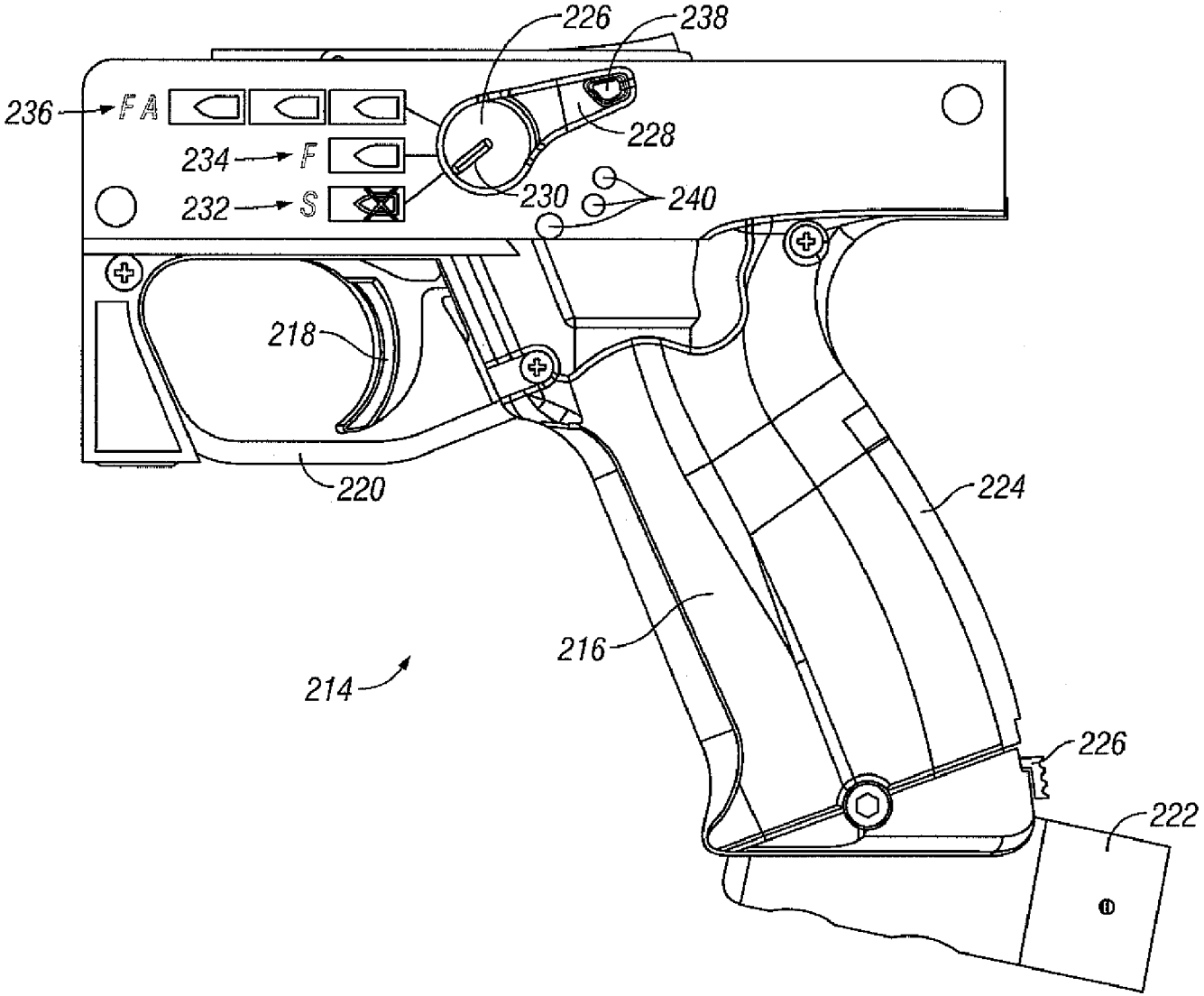
FIG. 23 shows an example grip assembly according to an alternative embodiment.

FIGS. 23-27 show a grip assembly 214 according to an alternative embodiment, which uses electronics (at least in part) to actuate firing of the marker 100. Referring to FIG. 23, the grip assembly 214 includes a grip 216 that is dimensioned for a user to grasp. As discussed below, the electronics (and related components) for controlling actuation of the marker 100 are disposed within the grip 216. The grip assembly 214 includes a trigger 218 for actuation by the user to fire the marker 100. In the example shown, the trigger 218 is surrounded by a trigger guard 220. As shown, the lower portion of the grip 216 includes an adaptor 222 configured to receive a propellant source, such as a canister of carbon dioxide or nitrogen. As discussed above, the adaptor 222 may be optional, depending on the type of rear stock attached to the receiver 104.

In this example, the grip 216 includes a battery door 224 that may be removed to provide access to a battery associated with the electronics (and possibly other components internal to the grip 216). Although the battery door 224 extends longitudinally along the rear portion of the grip 216 in the example shown, it should be appreciated that the battery door 224 could be located elsewhere on the grip 216 depending on the circumstances. As shown, the battery door 224 includes a clasp 226 for detachable coupling with the battery door 224. It should be appreciated that other mechanisms could be used for selectively opening/closing the battery door 224 to the rear portion of the grip 216.

In the embodiment shown, the grip assembly 214 includes a mode selector 226 for selecting among multiple firing modes. The term "firing mode" is intended to be broadly construed to include a safety position in which the marker 100 is prevented from firing, as well as modes that in the marker 100 are allowed to fire. In this example, the mode selector 226 includes a lever 228 for rotating the mode selector 226 between different firing modes. In the example shown, a mode indicator 230 aligns with the selected firing mode. As shown, the mode indicator 230 specifies that a first mode 232 is selected. By rotating the mode selector 226, a second mode 234 or a third mode 236 could be selected. As shown, an end of the lever 228 defines an opening 238 for receiving detents 240 to retain the mode selector 226 in the selected mode. Although a rotary mode selector 226 is shown for purposes of example, it should be appreciated that other non-rotating mode selectors, such as a linearly-moving lever, could be used. Although the embodiment shown includes three modes, it should be appreciated that embodiments are contemplated with only two modes; additionally, embodiments are contemplated with more than three modes.

Figure 24:
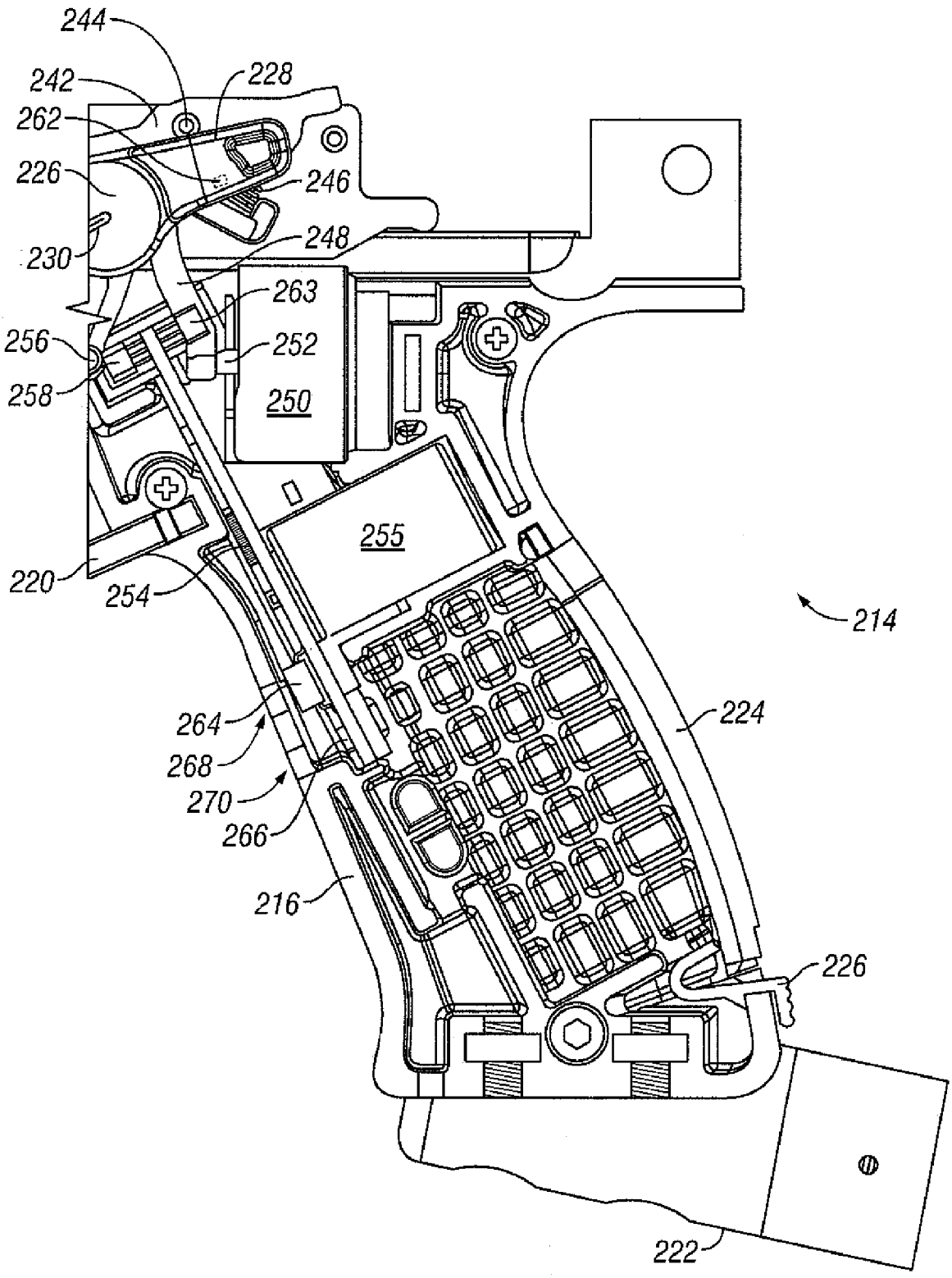
FIG. 24 shows a cross-sectional view of the example grip assembly of FIG. 23.
Figure 25:
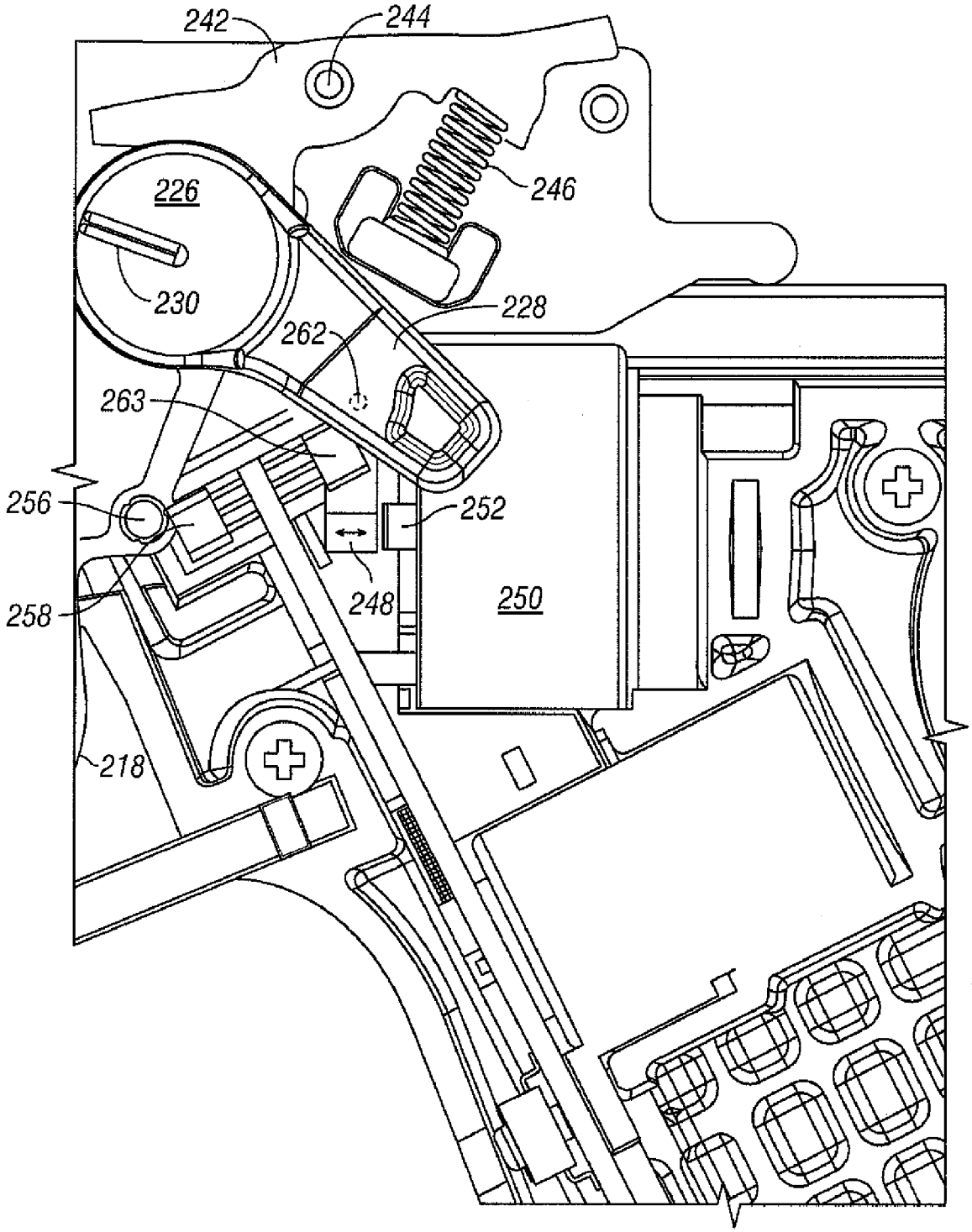
FIG. 25 is a detailed cross-sectional view of the example grip assembly.
Figure 26:
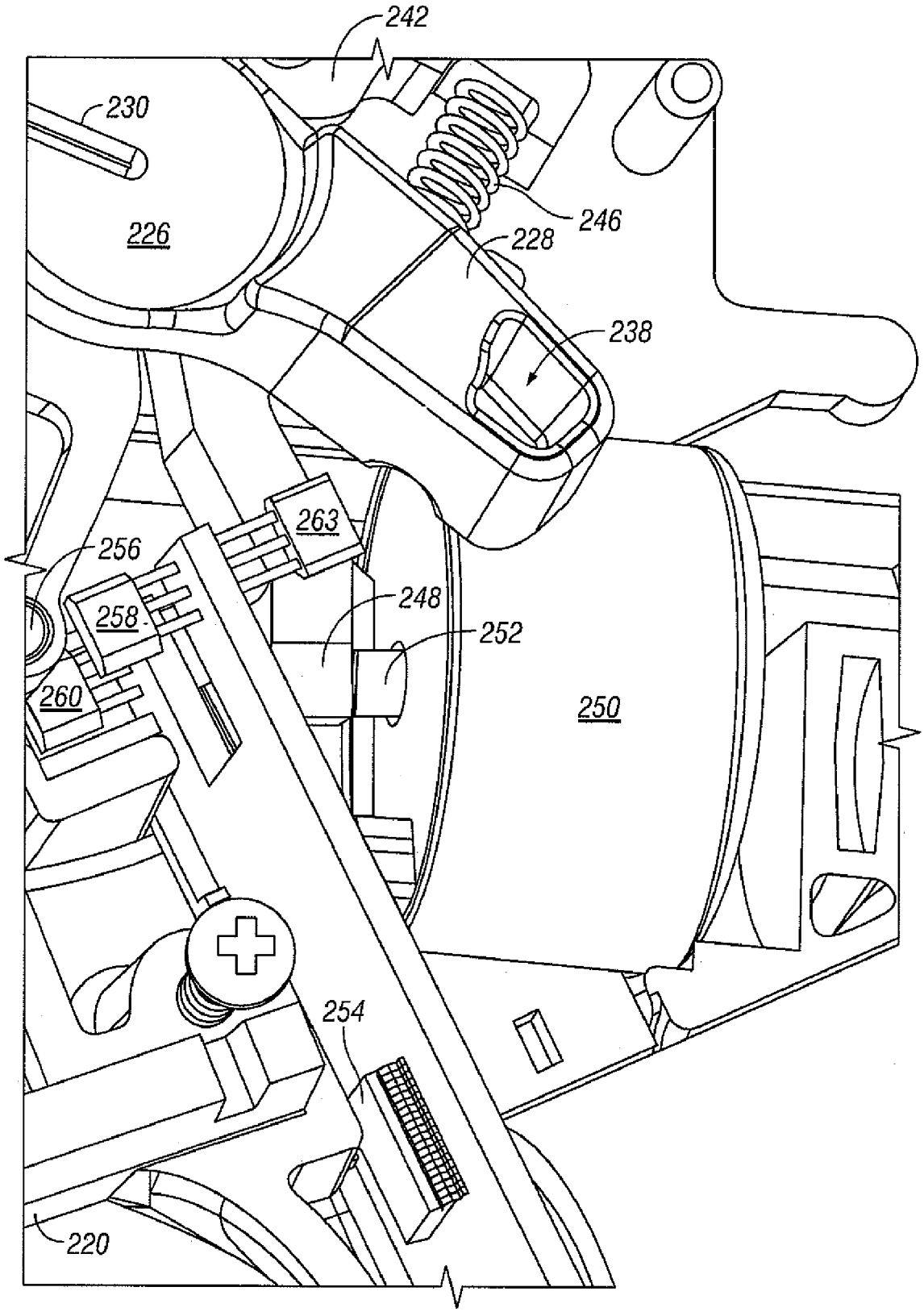
FIG. 26 is a detailed cross-sectional view of the grip assembly.

FIGS. 24-26 show cross-section views of the example grip assembly 214 shown in FIG. 23. Unlike the embodiment described previously with respect to FIG. 13, there is no contact between the trigger and sear in the embodiment shown. Instead, a controller circuit electronically detects movement of the trigger and actuates movement of the sear to fire the marker 100. In some embodiments, the manner by which the controller circuit controls movement of the sear could depend upon the firing mode and/or other firing characteristics selected by the user.

In the embodiment shown, a sear 242 pivots about a pivot pin 244 and the rear section (right portion in FIG. 24) is urged upward (in this example) by a biasing member 246. A depending portion 248 of the sear 242 extends toward a position adjacent a linear actuator 250, such as a solenoid. In the embodiment shown, the depending portion 248 is unitary with the sear 242; however, embodiments are contemplated in which the depending portion 248 and the sear 242 could be separate components that are coupled together. As shown, a rod 252 of the linear actuator 250 moves between a retracted position and an extended position (shown). When the rod 252 moves to the extended position, this pushes the depending portion 248 away from the linear actuator 250, which rotates the sear 242 (clockwise as shown) to fire the marker 100. For example, this movement of the sear 242 could release the rear bolt 190, which causes firing of the marker 100. In other embodiments, such as using combustible gas, this movement of the sear 242 could be used to initiate ignition in a combustion chamber.

Figure 27:
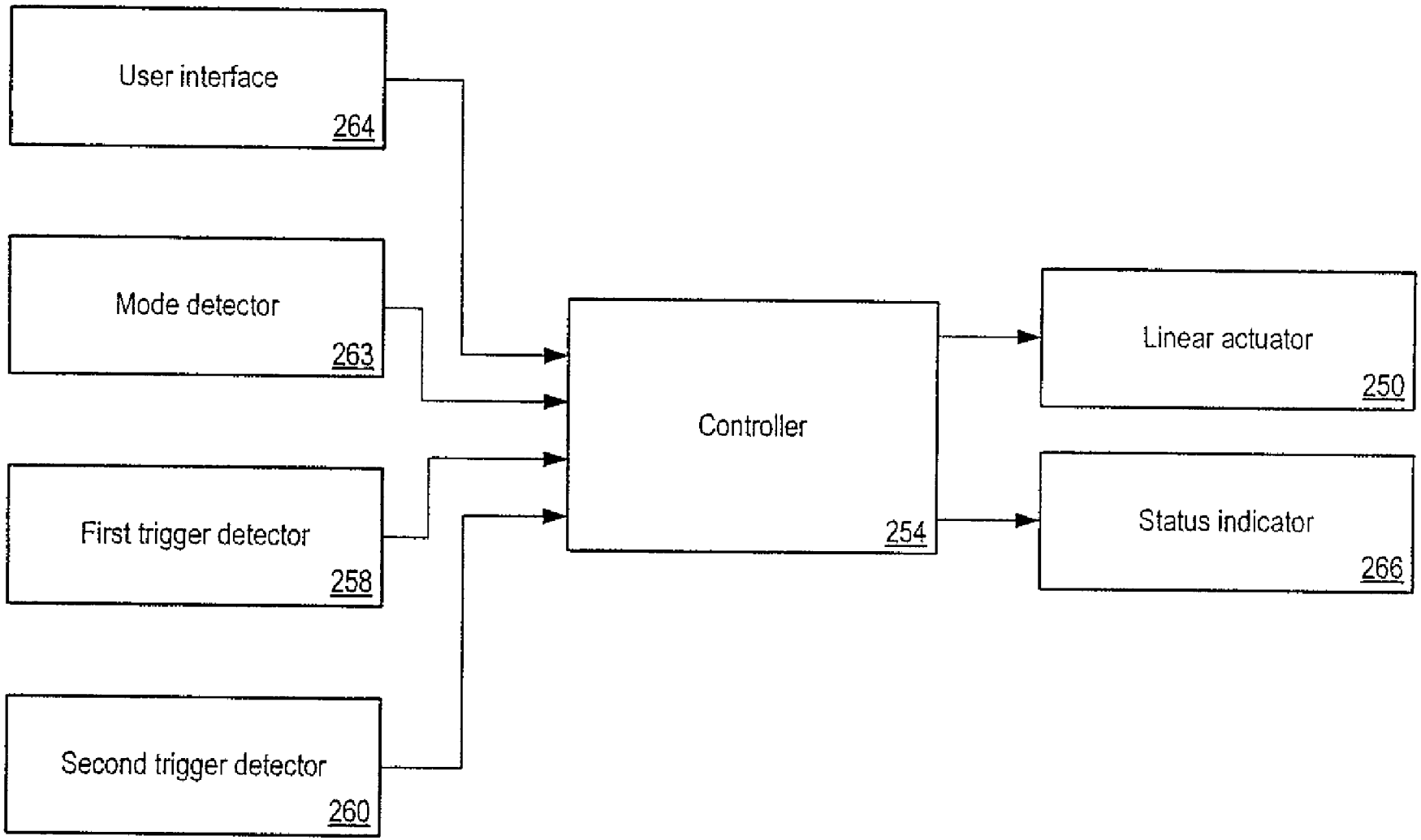
FIG. 27 is a schematic view showing possible inputs and outputs for the controller.

A controller 254 controls movement of the rod 252 responsive to movement of the trigger 218. The controller 254 could be a microcontroller, for example, that is programmed to perform the functions described herein. Other electronic components, such as a capacitor 255, could be associated with the controller. FIG. 27 is a simplified schematic representation showing possible inputs and outputs for the controller 254, according to an embodiment, which will be described below.

Referring again to FIGS. 24-26, the controller 254 determines when the trigger 218 is pulled by using one or more proximity sensors to detect the position of the trigger 218. Although the embodiment described below uses magnetic sensors, embodiments are contemplated in which other types of proximity sensors could be used, including but not limited to optical sensors, capacitive sensors, and inductive sensors.

In the example shown, a magnet 256 is associated with the trigger 218 that moves concomitant with the trigger 218. As shown, the magnet 256 is embedded in the trigger 218; however, embodiments are contemplated in which the magnet could be coupled with the trigger 218, such as using a fastener or adhesive. One or more magnetic sensors, such as Hall effect sensors, may be provided to detect the trigger's 218 position by detecting the magnetic flux associated with the magnet 256.

For example, in the embodiment shown, the magnet 256 is oriented to move between a first trigger detector 258 and a second trigger detector 260 when the trigger is pulled (as best seen in FIG. 26). With this arrangement, the controller 254 actuates the rod 252 to the extended position when both the first trigger detector 258 and the second trigger detector 260 sense the magnetic field of the magnet 256. Typically, the first trigger detector 258 and the second trigger detector 260 are Hall effect sensors. With such an arrangement, the trigger detectors 258 and 260 will switch on (output changing from low to high or visa versa) when the magnetic flux density increases above a threshold level, which indicates to the controller 254 that the trigger 218 has been pulled. In response, the controller 254 will actuate the rod 252 to the extended position, thereby moving the sear 242. When the magnetic flux density decreases below a threshold level, the trigger detectors 258 and 260 will switch off (output changing from high to low or visa versa), which indicates to the controller 254 that the trigger 218 has been released. The controller 254 will move the rod 252 to the retracted position. Typically, the rod 252 is held in the extended position for a pre-determined period of time, not dependent on the amount of time the trigger 218 is pulled.

In some embodiments, at least one of the first trigger detector 258 and the second trigger detector 260 are unipolar Hall effect sensors. By using a unipolar Hall effect sensor, safety advantages are provided because a specific magnetic orientation would be required to fire the marker 100, which reduces the possibility that external magnets would inadvertently cause the marker 100 to fire. For example, consider an example in which the first trigger detector 258 is a unipolar Hall effect sensor that switches on in response to a south pole and the second trigger detector 260 is an omnipolar Hall effect sensor that switches on in response to either a north pole or a south pole. In this example, the magnet 256 would be oriented on the trigger 218 such that the south pole would be exposed to the first trigger detector 258 when the user pulls the trigger 218. With this type of arrangement, the magnet 256 could include a pole indicator printed on a side, such as text or a graphic, for maintenance purposes if the user needed to replace the magnet 256 so that the correct orientation could be determined.

In some embodiments, a magnet 262 is associated with the mode selector 226 that moves concomitant with rotation of the mode selector 226. The magnet 262 may be embedded in the mode selector 226 coupled with the mode selector 226 using a fastener, adhesive, or otherwise associated with the mode selector 226. In the embodiment shown, a mode detector 263 is provided to detect the position of the mode selector 226. For example, the mode detector could be a magnetic sensor, such as a Hall-effect sensor, to detect the mode selector's 226 position by detecting the magnetic flux associated with the mode selector 226. This allows the controller 254 to determine the firing mode selected by the user. Other embodiments are contemplated in which other types of electronics could be used to select the firing mode, including but not limited to tactile switches, optical-electronics, momentary switches, push-button switches, rotary switches, and capacitive sensors.

In the embodiment shown, the grip assembly 214 includes a user interface 264 and a status indicator 266 on an end of the grip 216 opposite the battery door 224. As shown, a first opening 268 provides access to the user interface 264, while a second opening 270 exposes the status indicator 266. In the example shown, the user interface 264 is a momentary push-button switch; however, other embodiments are contemplated in which other suitable switches, knobs, etc., could be used. Although the status indicator 266 will be described herein as a LED with multiple colors (e.g., red/green/orange), it should be appreciated that other mechanisms, such as audible alerts, a LCD display, etc., would be suitable to provide information to the user regarding the marker 100.

The user interface 264 allows the user to turn off the electronics. For example, pushing the user interface 264 for greater than a specific time, such as two seconds, could turn off the electronics. The status indicator 266 could be used to let the user know that the electronics is turned off. For example, the status indicator could light up red when the user has pushed the user interface for a sufficient period to turn off the electronics.

Additionally, the user interface 264 can be used to adjust the manner by which the marker 100 fires. For example, the user interface 264 could allow the user to select the default firing mode associated with modes 234 and 236. Consider an example in which the user pushes the user interface 264 for approximately 0.5 seconds (or another predetermined time) and releases the user interface 264, then the status indicator 266 starts flashing orange (or other color). In this example, the status indicator could flash a number of times corresponding with default firing mode. By way of example only, the firing modes could be: (1) safe three-round burst—pulling the trigger three times in less than a second will result in a 3-shot burst; (2) safe full-auto—pulling the trigger three times in less than a second will result in full-automatic firing; (3) auto-response—firing upon both pulling and releasing the trigger; (4) turbo mode—pulling the trigger three times in less than one second will result in full-automatic firing at a rate of 15 bps (or other predetermined rate); (5) semi-auto—firing each time the trigger is pulled. In this example, the user will know that the marker 100 is set to the safe full-auto mode as the default firing mode if the status indicator 266 flashes twice. It should be appreciated that the firing modes listed above are provided for example purposes only and are not intended to limit the types or number of firing modes that could be used.

In some embodiments, the user can change multiple characteristics by which the marker 100 fires. Consider an example in which four characteristics of the marker 100 could be changed: (1) dwell—the amount of time that the linear actuator 250 is powered during a trigger pull; (2) debounce—the minimum amount of time between accepted trigger pulls; (3) rate-of-fire; and (4) default firing mode. By way of example only, the user could enter a programming mode to change one or more of these characteristics by simultaneously pushing the user interface 264 and the trigger 218 for a predetermined period of time.

Once in the programming mode, the status indicator 266 could indicate the particular characteristic selected to be changed. By way of example only, the status indicator 266 could indicate the selected characteristics as follows: (1) solid red—dwell; (2) solid green—debounce; (3) flashing green—rate-of-fire; and (4) alternating red/green—default firing mode. In some embodiments, the user could cycle between these characteristics using the trigger 218. In this example, the status indicator would cycle from solid red (dwell) to solid green (debounce) when the trigger 218 is pulled and then from solid green (debounce) to flashing green (rate-of-fire) when the trigger 218 is pulled again and then from flashing green (rate-of-fire) to alternating red/green (default firing mode) if the trigger 218 is pulled again. To select a particular characteristic to change, the user could pull and hold the trigger for a predetermined time, for example. When this is done, the status indicator 266 could flash the current value selected for the characteristic. If the user selected debounce, for example, the status indicator 266 could flash 30 times if the debounce value had been set to 30 milliseconds.

To enter a different value, the user could pull the trigger the number of times needed to select the desired value. Consider an example in which the user selected the dwell characteristic to change. In this example, the default dwell value could be 8 milliseconds and may be adjusted between 2-20 milliseconds. If the user wanted to change the dwell value to 10 milliseconds, the user would pull the trigger 10 times. Once the user has entered the desired value, the status indicator 266 could flash (or otherwise indicate) that the value is accepted and stored.

Consider another example in which the user selected the debounce value to change. In this example, the default debounce value could be 52 milliseconds and may be adjusted between 25-65 milliseconds. If the user wanted to change the debounce value to 25 milliseconds, for example, the user would pull the trigger 25 times. Once the user has entered the desired value, the status indicator 266 could flash (or otherwise indicate) that the value is accepted and stored.

Consider a further example in which the user selected the rate-of-fire value to change. In this example, the default rate-of-fire value could be 13 balls per second and may be adjusted between 8-30 balls per second. If the user wanted to change the rate-of-fire value to 20 balls per second, for example, the user would pull the trigger 20 times. Once the user has entered the desired value, the status indicator 266 could flash (or otherwise indicate) that the value is accepted and stored.

Consider another example in which the user selected the firing mode value to change. In this example, the firing mode value could be 2, which could correspond to safe full-auto. If the user wanted to change the firing mode to auto-response, which corresponds to a firing mode value of 3 in this example, the user would pull the trigger 3 times. Once the user has entered the desired value, the status indicator 266 could flash (or otherwise indicate) that the value is accepted and stored.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An electronic grip assembly for a paintball marker, the electronic grip assembly comprising:

a grip defining an interior cavity;

trigger movable between a neutral position and a firing position;

a magnet associated with and movable with the trigger, wherein the magnet has a first pole and a second pole;

a first magnetic sensor configured to detect the magnet, wherein the first magnetic sensor is spaced apart from the magnet such that the first magnetic sensor detects the magnet when the trigger is in the firing position, but does not detect the magnet when the trigger is in the neutral position;

a second magnetic sensor configured to detect the magnet, wherein the second magnetic sensor is spaced apart from the magnet such that the second magnetic sensor detects the magnet when the trigger is in the firing position, but does not detect the magnet when the trigger is in the neutral position;

a controller disposed within the interior cavity of the grip, wherein the controller is configured to actuate launching of a projectile responsive to detection of the magnet by both the first magnetic sensor and the second magnetic sensor; and wherein at least a portion of the trigger is disposed between the first magnetic sensor and the second magnetic sensor when in the firing position.

2. The electronic grip assembly of claim 1, wherein the first magnetic sensor is adapted to detect the first pole of the magnet, but not the second pole and wherein the magnet is oriented such that the first magnetic sensor detects the first pole when the trigger is in the firing position, but does not detect the first pole when the trigger is in the neutral position.

3. The electronic grip assembly of claim 2, wherein the first magnetic sensor is a unipolar Hall effect sensor configured to detect the first pole of the magnet when the trigger is in the firing position.

4. The electronic grip assembly of claim 3, wherein the first pole of the magnet is the south pole.

5. The electronic grip assembly of claim 3, wherein the second magnetic sensor is a Hall effect sensor configured to detect at least one of the first pole and the second pole of the magnet.

6. The electronic grip assembly of claim 1, further comprising a linear actuator in electrical communication with the controller, wherein the linear actuator is movable between a retracted position and an extended position.

7. The electronic grip assembly of claim 6, wherein the controller is configured to actuate the linear actuator from the retracted position to the extended position responsive to detection of the magnet by both the first magnetic sensor and the second magnetic sensor.

8. The electronic grip assembly of claim 7, wherein the controller is configured to actuate the linear actuator pursuant to at least one of the following user-selectable firing characteristics: dwell, debounce, rate-of-fire, and firing mode.

9. The electronic grip assembly of claim 8, further comprising a user interface in electronic communication with the controller, wherein the user interface is configured to select at least one of the following firing characteristics to be adjusted: dwell, turbo, debounce, rate-of-fire, and firing mode.

10. The electronic grip assembly of claim 9, wherein the controller is configured to adjust firing characteristics responsive to a number of times a user pulls a trigger upon selection of a firing characteristic to be adjusted.

11. The electronic grip assembly of claim 10, wherein a dwell value is adjustable between approximately 2 and 20 milliseconds.

12. The electronic grip assembly of claim 10, wherein a debounce value is adjustable between approximately 25 and 65 milliseconds.

13. The electronic grip assembly of claim 10, wherein rate-of-fire is adjustable between approximately 8 and 30 balls per second.

14. The electronic grip assembly of claim 1, wherein the grip includes a front wall adjacent the trigger and an opposing rear wall, further comprising a battery door for accessing the interior cavity of the grip, wherein the battery door forms at least a portion of the grip's rear wall.

15. The electronic grip assembly of claim 14, wherein the battery door includes a clasp for opening and closing the battery door, wherein at least a portion of the clasp forms at least a portion of the rear wall.

16. The electronic grip assembly of claim 14, further comprising a LED in electronic communication with the controller.

17. The electronic grip assembly of claim 1, further comprising a rotary mode selector configured to move between a first firing mode and a second firing mode, wherein the rotary mode selector prevents rearward movement of the trigger when in the first firing mode.

18. The electronic grip assembly of claim 17, further comprising a magnet associated with and movable with the rotary mode selector and magnetic sensor configured to detect the magnet when the rotary mode selector is in the second firing position, but not when the rotary mode selector is in the first firing position.

19. An electronic grip assembly for a paintball marker, the electronic grip assembly comprising:

a grip defining an interior cavity;

a trigger movable between a neutral position and a firing position;

a controller disposed within the interior cavity of the grip, wherein the controller is programmed with a plurality of firing modes;

a mode selector movable between a first position and a second position, wherein the mode selector prevents the trigger from moving to the firing position when in the first position and wherein the second position of the mode selector is associated with a default firing mode selected from the plurality of firing modes programmed on the controller;

wherein the controller is adapted to actuate launching of a projectile according to the default firing mode responsive to the trigger moving to the firing position when the mode selector is in the second position; and wherein at least a portion of the mode selector extends from an external surface of the receiver.

20. The electronic grip assembly of claim 19, wherein the mode selector rotates between the first position and the second position.

21. The electronic grip assembly of claim 19, wherein the mode selector is moveable between a first position, a second position, and a third position, wherein the third position is associated with a predetermined firing mode.

22. The electronic grip assembly of claim 21, wherein the predetermined firing mode is semi-automatic.

23. The electronic grip assembly of claim 19, wherein the default firing position associated with the second position is user adjustable.

24. The electronic grip assembly of claim 23, wherein the predetermined firing mode is unalterable by a user.

25. The electronic grip assembly of claim 23, further comprising a user interface in electrical communication with the controller.

26. The electronic grip assembly of claim 25, wherein the controller is configured to change the default firing mode responsive to user actuation of the user interface and the trigger.

27. The electronic grip assembly of claim 26, wherein the user interface comprises a momentary push-button switch.

28. The electronic grip assembly of claim 19, further comprising a proximity switch in electronic communication with the controller, wherein the proximity switch is configured to detect a position of the mode selector.

29. The electronic grip assembly of claim 28, further comprising a magnet coupled with the mode selector, wherein the proximity switch is a magnetic sensor that detects whether the mode selector is in the first position or the second position based on the proximity of the magnetic sensor to the magnet.

30. The electronic grip assembly of claim 29, wherein the magnetic sensor is a Hall effect sensor.

31. A paintball marker comprising:

a receiver;

a barrel extending from the receiver;

a grip assembly comprising:

a grip defining an interior cavity;

trigger movable between a neutral position and a firing position;

a magnet associated with and movable with the trigger, wherein the magnet has a first pole and a second pole;

a first magnetic sensor configured to detect the magnet, wherein the first magnetic sensor is spaced apart from the magnet such that the first magnetic sensor detects the magnet when the trigger is in the firing position, but does not detect the magnet when the trigger is in the neutral position;

a second magnetic sensor configured to detect the magnet, wherein the second magnetic sensor is spaced apart from the magnet such that the second magnetic sensor detects the magnet when the trigger is in the firing position, but does not detect the magnet when the trigger is in the neutral position;

a mode selector movable between a first position and a second position, wherein the mode selector prevents the trigger from moving to the firing position when in the first position and wherein the second position of the mode selector is associated with a default firing mode selected from the plurality of firing modes programmed on the controller;

a controller disposed within the interior cavity of the grip, wherein the controller is configured to actuate launching of a projectile responsive to detection of the magnet by both the first magnetic sensor and the second magnetic sensor, wherein the controller is adapted to actuate launching of a projectile according to the default firing mode responsive to the trigger moving to the firing position when the mode selector is in the second position;

wherein at least a portion of the trigger is disposed between the first magnetic sensor and the second magnetic sensor when in the firing position; and wherein at least a portion of the mode selector extends from an external surface of the receiver; and a projectile launching assembly configured to propel a projectile out of the barrel responsive to the controller.

32. The paintball marker of claim 31, wherein the first magnetic sensor is adapted to detect the first pole of the magnet, but not the second pole, and wherein the magnet is oriented such that the first magnetic sensor detects the first pole when the trigger is in the firing position, but does not detect the first pole when the trigger is in the neutral position.

33. The paintball marker of claim 32, wherein the first magnetic sensor is a unipolar Hall effect sensor configured to detect the first pole of the magnet when the trigger is in the firing position.

34. The paintball marker of claim 31, wherein the mode selector rotates between the first position and the second position.

35. An electronic grip assembly for a paintball marker, the electronic grip assembly comprising:

a grip defining an interior cavity, wherein the grip includes a front wall and an opposing rear wall;

trigger movable between a neutral position and a firing position;

a trigger guard extending from the front wall of the grip;

a battery door for accessing the interior cavity of the grip, wherein the battery door forms at least a portion of the rear wall of the grip; and an electronic circuit at least partially disposed within the interior cavity of the grip, wherein the electronic circuit is configured to actuate launching of a projectile responsive to the trigger moving to the firing position.

36. The electronic grip assembly of claim 35, wherein the battery door has a first end with a flange and a second end, wherein rear wall defines a recess dimensioned to receive the flange.

37. The electronic grip assembly of claim 36, wherein the second end includes a clasp for detachably coupling the battery door to the rear wall.

38. The electronic grip assembly of claim 37, wherein the clasp is unitary with the battery door.

39. The electronic grip assembly of claim 35, wherein the electronic circuit includes a status indicator configured to indicate a status of the electronic circuit and wherein the front wall includes an opening adjacent the status indicator so that the status indicator is visible through the opening.

40. The electronic grip assembly of claim 39, wherein the status indicator comprises a LED.

41. The electronic grip assembly of claim 35, wherein the electronic circuit includes a user interface configured to adjust an operation of the electronic circuit and wherein the front wall includes an opening adjacent the user interface so that the user interface is accessible to a user through the opening.

42. The electronic grip assembly of claim 41, wherein the user interface is a momentary push-button switch.

* * * * *